US008419489B2

(12) United States Patent
Tsunekawa et al.

(10) Patent No.: US 8,419,489 B2
(45) Date of Patent: Apr. 16, 2013

(54) PROPELLER UNIT FOR MARINE VESSEL PROPULSION DEVICE AND MARINE VESSEL PROPULSION DEVICE INCLUDING THE SAME

(75) Inventors: Hiroyuki Tsunekawa, Shizuoka (JP); Shunsuke Yukawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 201 days.

(21) Appl. No.: 12/885,650

(22) Filed: Sep. 20, 2010

(65) Prior Publication Data

US 2011/0212657 A1 Sep. 1, 2011

(30) Foreign Application Priority Data

Feb. 26, 2010 (JP) ..... 2010-042813

(51) Int. Cl.
*F01D 5/26* (2006.01)
*B63H 23/24* (2006.01)

(52) U.S. Cl.
USPC ..... 440/83; 416/134 R

(58) Field of Classification Search ..... 440/83, 440/51, 75, 49; 464/179–183; 416/131, 416/134 R
See application file for complete search history.

(56) References Cited

U.S. PATENT DOCUMENTS 4,575,310 A 3/1986 Otani
4,747,796 A * 5/1988 Iwai et al. ..... 440/83
5,252,028 A * 10/1993 LoBosco et al. ..... 416/93 A
6,383,042 B1 * 5/2002 Neisen ..... 440/49
6,547,613 B1 * 4/2003 Onoue et al. ..... 440/83
6,609,892 B1 8/2003 Kreul et al.
7,086,836 B1 * 8/2006 Sheth et al. ..... 416/134 R
7,343,899 B2 * 3/2008 Kanno et al. ..... 123/396
2007/0053777 A1 3/2007 Harada

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A propeller unit for a marine vessel propulsion device includes an inner cylinder arranged to be fixed to the propeller shaft, an outer cylinder, a first driving force transmitting member, and a second driving force transmitting member. The propeller unit for marine vessel propulsion device further includes a pair of first engaging portions, and a pair of second engaging portions provided on the outer cylinder and the second driving force transmitting member. The pair of second engaging portions are arranged such that the mutual engaging of the respective second engaging portions is disengaged when a driving force is not transmitted to the propeller shaft and are arranged such that the respective second engaging portions become mutually engaged in a driving force transmittable manner by elastic deformation of the first driving force transmitting member when a driving force that is not less than a reference driving force is transmitted to the propeller shaft.

19 Claims, 13 Drawing Sheets

PROPELLER UNIT FOR MARINE VESSEL PROPULSION DEVICE AND MARINE VESSEL PROPULSION DEVICE INCLUDING THE SAME

BACKGROUND OF THE INVENTION

1. Field of the Invention

The present invention relates to a propeller unit for a marine vessel propulsion device arranged to be attached to a propeller shaft driven by an engine or other motor and relates to a marine vessel propulsion device that includes the propeller unit.

2. Description of Related Art

A propeller unit of a marine vessel propulsion device includes, for example, an inner cylinder fixed to a propeller shaft, an outer cylinder surrounding the inner cylinder, and a cylindrical damper made of rubber and disposed between the inner cylinder and the outer cylinder. The damper is fixed to the inner cylinder, and the damper that is made integral with the inner cylinder is press fitted into the outer cylinder. A driving force transmitted from the engine to the propeller shaft is transmitted via the inner cylinder and the damper to the outer cylinder and rotates blades fixed to the outer cylinder. The blades thereby push the water and a propulsive force that propels the marine vessel is generated.

An outboard motor, which is one example of a marine vessel propulsion device, may be provided with a shift mechanism for switching a direction of the propulsive force between a forward drive direction and a reverse drive direction. A typical shift mechanism includes a dog clutch, a forward drive gear, and a reverse drive gear. The dog clutch is spline-connected to the propeller shaft and is arranged to be selectively coupled to the forward drive gear and the reverse drive gear. A rotation of a driveshaft that transmits the driving force from the engine is constantly transmitted to the forward drive gear and the reverse drive gear. The forward drive gear and the reverse drive gear are arranged to receive the driving force from the driveshaft and rotate in mutually opposite directions. When the dog clutch is coupled to the forward drive gear, the propeller unit rotates in a direction of generating a propulsive force that drives the marine vessel forward. When the dog clutch is coupled to the reverse drive gear, the propeller unit rotates in a direction of generating a propulsive force that drives the marine vessel in reverse. When the dog clutch is not coupled to either of the forward drive gear and the reverse drive gear, the driving force of the engine is not transmitted to the propeller unit.

An operation by which the dog clutch becomes coupled the forward drive gear or the reverse drive gear is called "shift-in," and an operation in which the dog clutch is released from being coupled to the forward drive gear or the reverse drive gear is called "shift-out." Hereinafter, the shift-in and shift-out operations shall be referred to collectively as "shift switching." During shift switching, a shock (shift shock) occurs in the dog clutch and the propeller shaft. A main cause of the shift shock is a large inertial mass of the propeller unit. For example, when shift-in occurs while the rotation of the propeller unit is stopped, the dog clutch that is in a rotation-stopped state engages with the forward drive gear or the reverse drive gear that is being rotated by the engine. The dog clutch is spline-connected to the propeller shaft, and the propeller unit with the large inertial mass is coupled to the propeller shaft. A strong impact thus occurs when the forward drive gear or the reverse drive gear becomes coupled to the dog clutch. During shift-out, although a shift shock occurs because the large inertial mass is cut off from the engine, the shift shock is not as strong as that during shift-in.

The shift shock can be reduced by making the damper rubber of the propeller unit soft. For example, the shift shock is alleviated by a soft damper being strongly twisted between the outer cylinder and inner cylinder during shift-in.

However, it is insufficient for the damper to just be able to alleviate the shift shock and it must also be able to transmit the driving force of the propeller shaft to the blades. More specifically, the damper must transmit the driving force of the propeller shaft from the inner cylinder to the outer cylinder without undergoing rupture, slipping, etc., between the inner cylinder and the outer cylinder. For this purpose, it is desirable for the damper to be as hard as possible.

Thus, generally, a material of the damper is determined in consideration of balancing both a shift shock reducing function and a driving force transmitting function. It was thus difficult to improve both functions at the same time.

A propeller unit, with which a damper provides a shift shock reducing function and a driving force of a propeller shaft is transmitted to an outer cylinder mainly by a hard material except the damper, is described in US 2007/053777A1. This propeller unit includes an inner cylinder fixed to the propeller shaft, the outer cylinder to which blades are fixed, an intermediate cylinder arranged between the inner cylinder and the outer cylinder, and a cylindrical damper disposed between the intermediate cylinder and the inner cylinder. The shift shock is alleviated by elastic deformation of the damper between the inner cylinder and the intermediate cylinder. When the driving force of the propeller shaft is small, the driving force of the propeller shaft is transmitted in the order of the inner cylinder, the damper, the intermediate cylinder, the outer cylinder, and the blades. When the driving force of the propeller shaft becomes not less than a predetermined value, an elastic deformation amount of the damper increases and the intermediate cylinder rotates by a predetermined angle with respect to the inner cylinder. In this process, a first engaging member formed at a rear end of the intermediate cylinder engages with a second engaging member formed at a rear end of the inner cylinder and the intermediate cylinder and the inner cylinder are thereby coupled rigidly. The driving force of the propeller shaft is thus transmitted in the order of the second engaging member of the inner cylinder, the first engaging member of the intermediate cylinder, the outer cylinder, and the blades, and a large driving force is not transmitted to the damper. The driving force can thus be transmitted from the propeller shaft to the blades without dependence on the rigidity of the damper.

With the propeller unit for marine vessel propulsion device described in US 2007/053777 A1, a torque that is transmitted between the intermediate cylinder and the outer cylinder is restricted to no more than a predetermined torque by a tolerance ring arranged between the intermediate cylinder and the outer cylinder. Thus, when the blades receive a strong impact temporarily, the outer cylinder rotates idly with respect to the intermediate cylinder. Application of an impact load to the power transmission system between the propeller shaft and the engine is thereby prevented.

SUMMARY OF THE INVENTION

The inventors of preferred embodiments of the present invention described and claimed in the present application conducted an extensive study and research regarding a propeller unit for marine vessel propulsion device, such as the one described above, and in doing so, discovered and first recognized new unique challenges and previously unrecognized possibilities for improvements as described in greater detail below.

When a marine vessel travels through a shallow region crowded with rocks projecting from a seafloor (rocky reef region), the propeller unit for marine vessel propulsion device according to US 2007/053777A1 may generate loud impact noises. Specifically, impact noises are generated when the blades collide with the rocks on the seafloor. Depending on conditions of the rocky reef region, the blades may alternatingly receive an impact force in the direction of rotation of the propeller unit and an impact force in the opposite direction. In this process, the propeller unit repeatedly alternates between forward rotation and reverse rotation within a short time. In this case, according to the arrangement of US 2007/053777A1, the first engaging member sandwiched between two second engaging members collide against the two engaging members alternatingly and impact noises are thereby generated repeatedly. The repeatedly generated impact noises are perceived as loud impact noises by occupants of the marine vessel.

In order to overcome the previously unrecognized and unsolved challenges described above, a preferred embodiment of the present invention provides a propeller unit arranged to be coupled to a propeller shaft of a marine vessel propulsion device, the propeller unit includes an inner cylinder fixed to the propeller shaft, an outer cylinder having a cylindrical shape that is coaxial with the inner cylinder and including blades fixed on an outer circumferential surface of the outer cylinder, a first driving force transmitting member including a cylindrical elastic member arranged between the inner cylinder and the outer cylinder, and a second driving force transmitting member arranged between the inner cylinder or the propeller shaft and the outer cylinder and aligned with the first driving force transmitting member in an axial direction of the outer cylinder. The propeller unit further includes a pair of first engaging portions arranged on the outer cylinder and the first driving force transmitting member and arranged to mutually engage such that a driving force is transmittable to each other, and a pair of second engaging portions arranged on the outer cylinder and the second driving force transmitting member. The pair of second engaging portions are arranged such that a mutual engaging of the respective second engaging portions is disengaged when a driving force is not transmitted to the propeller shaft and are arranged such that the respective second engaging portions become mutually engaged in a driving force transmittable manner by elastic deformation of the first driving force transmitting member when a driving force that is not less than a reference driving force not exceeding a critical load of the first driving force transmitting member is transmitted to the propeller shaft.

According to this arrangement, the first driving force transmitting member is an elastic member and can thus absorb shift shock and other impacts applied to the propeller shaft. The second driving force transmitting member is provided apart from the first driving force transmitting member. The driving force applied to the propeller shaft can thus be transmitted to the outer cylinder (blades) via the second driving force transmitting member when the driving force transmitted to the propeller shaft is not less than the reference driving force. The driving force that the first driving force transmitting member must transmit from the propeller shaft to the outer cylinder may thus be small and a material of the first driving force transmitting member can thus be made soft. An effect of reducing shift shock and other impacts by the first driving force transmitting member can thereby be increased. When the driving force transmitted to the propeller shaft is less than the reference driving force, the second driving force transmitting member is not coupled to the outer cylinder in a driving force transmittable manner. In this case, the driving force applied to the propeller shaft is transmitted to the outer cylinder via the first driving force transmitting member. The impact absorbing effect by the first driving force transmitting member can thus be exhibited reliably.

When the driving force transmitted to the propeller shaft increases and the first driving force transmitting member deforms elastically to some degree, a state where the second driving force transmitting member transmits the driving force to the outer cylinder is entered. The reference driving force is set to be less than the critical load of the first driving force transmitting member. The second driving force transmitting member thus becomes coupled and transmits the driving force to the outer cylinder before a load that is not less than the critical load is applied to the first driving force transmitting member. Breakage of the first driving force transmitting member can thus be prevented even if a large impact is applied to the blades or the outer cylinder.

The critical load is defined as a magnitude of a load of a level at which the member concerned does not break. For example, whether or not the critical load of the first driving force transmitting member is exceeded can be judged as follows. First, a case where a forward rotation operation of making the propeller shaft and the propeller unit rotate in one direction and a reverse rotation operation of making the propeller shaft and the propeller unit rotate in another direction are repeated shall be considered. An operation of applying a fixed load in the forward rotation direction and thereafter applying the fixed load in the reverse rotation direction shall be regarded as one load cycle. If even after repeatedly applying the fixed load to the first driving force transmitting member for a predetermined number of times (for example, 1000 times) of the load cycle, breakage, plastic deformation, slipping with respect to the outer cylinder, or other state where the first driving force transmitting member loses its inherent function does not occur, it can be judged that the critical load of the first driving force transmitting member is not exceeded. The reference driving force is of a magnitude of a load that does not exceed the critical load. When a driving force that is not less than the reference driving force is transmitted, the pair of second engaging portions become mutually engaged in a driving force transmittable manner by elastic deformation of the first driving force transmitting member.

When the driving force transmitted to the propeller shaft is not less than the reference driving force, such as when the rotation speed of the propeller shaft is high, etc., the driving force of the propeller shaft can be transmitted to the outer cylinder via the second driving force transmitting member. The driving force applied to the propeller shaft can thus be transmitted reliably to the outer cylinder and the blades.

In a case where the marine vessel travels through a rocky reef region, the blades may contact a plurality of rocks and receive forces from the plurality of rocks. In this case, the blades may alternatingly receive an impact force in the direction of rotation of the propeller unit and an impact force in the opposite direction from the plurality of rocks. The propeller unit then repeatedly alternates between forward rotation and reverse rotation within a short time. The pair of second engaging portions thus tends to repeatedly undergo mutual engaging and disengagement of mutual engaging. However, an impact that occurs when the pair of second engaging portions undergo the process of becoming engaged can be attenuated by the elastic deformation of the first driving force transmitting member. Impact noise can thereby be reduced.

The second driving force transmitting member is preferably formed of a material that is the same in hardness as the first driving force transmitting member or a material that is harder than the first driving force transmitting member. The driving force that can be transmitted from the propeller shaft to the outer cylinder via the second driving force transmitting member can thus be made large. The share of the driving force of the propeller shaft received by the first driving force transmitting member can be decreased accordingly, and the effect of preventing the breakage of the first driving force transmitting member can thereby be increased. The second driving force transmitting member may be formed of a metal material, for example.

Preferably, the pair of first engaging portions include a first protrusion provided on the outer cylinder and arranged to protrude inward from an inner circumferential surface of the outer cylinder and a first groove provided in an outer circumferential surface of the first driving force transmitting member and arranged to be coupled in a driving force transmittable manner to the first protrusion. According to this arrangement, the engaging of the pair of first engaging portions can be realized in a simple manner.

In this case, it is preferable in terms of enhancing the impact noise reducing effect that the first protrusion and the first groove be constantly engaged in the driving force transmittable manner.

Preferably, the pair of second engaging portions include a second protrusion provided on the second driving force transmitting member and a second groove. The second groove includes a pair of side surfaces provided in the outer cylinder and opposing each other in a circumferential direction of the outer cylinder, and the second groove is arranged such that the second protrusion is inserted between the pair of side surfaces. Further, the second groove is arranged such that gaps are provided between the second protrusion and the respective side surfaces when a driving force is not transmitted to the propeller shaft, and the second groove is arranged such that the second protrusion is made to contact one of the pair of side surfaces by elastic deformation of the first driving force transmitting member when a driving force that is not less than the reference driving force not exceeding the critical load of the first driving force transmitting member is transmitted to the propeller shaft.

According to this arrangement, when the driving force that is not less than the reference driving force is transmitted to the propeller shaft, the large driving force can be transmitted by the pair of second engaging portions by contact of the second protrusion and one of the pair of side surfaces of the second groove.

In another preferred embodiment of the present invention, the pair of second engaging portions include a second protrusion provided on the outer cylinder and a second groove. The second groove includes a pair of side surfaces provided in the second driving force transmitting member and opposing each other in a circumferential direction of the outer cylinder, the second groove arranged such that the second protrusion is inserted between the pair of side surfaces. Further, the second groove is arranged such that gaps are provided between the second protrusion and the respective side surfaces when a driving force is not transmitted to the propeller shaft, the second groove is arranged such that the second protrusion is made to contact one of the pair of side surfaces by elastic deformation of the first driving force transmitting member when a driving force that is not less than the reference driving force not exceeding the critical load of the first driving force transmitting member is transmitted to the propeller shaft.

According to this arrangement, when the driving force that is not less than the reference driving force is transmitted to the propeller shaft, the large driving force can be transmitted by the pair of second engaging portions by contact of the second protrusion and one of the pair of side surfaces of the second groove.

A preferred embodiment of the present invention further includes a third driving force transmitting member including a cylindrical elastic member arranged between the inner cylinder and the outer cylinder, and a pair of third engaging portions provided on the outer cylinder and the third driving force transmitting member. The pair of third engaging portions are arranged such that the mutual engaging of the respective third engaging portions is disengaged when a driving force is not transmitted to the propeller shaft and arranged such that the respective third engaging portions become mutually engaged in a driving force transmittable manner by elastic deformation of the first driving force transmitting member when a driving force that is not less than a first driving force less than the reference driving force is transmitted to the propeller shaft. Further, the pair of second engaging portions are arranged such that the respective second engaging portions become mutually engaged in a driving force transmittable manner by elastic deformation of the first driving force transmitting member and the third driving force transmitting member when a driving force not less than a second driving force is transmitted to the propeller shaft, the second driving force being the reference driving force not exceeding the critical load of the first driving force transmitting member and not exceeding a critical load of the third driving force transmitting member.

According to this arrangement, when the driving force transmitted to the propeller shaft is less than the first driving force, the driving force applied to the propeller shaft is transmitted from the inner cylinder to the outer cylinder via the first driving force transmitting member. When the driving force transmitted to the propeller shaft is not less than the first driving force and less than the second driving force, the driving force applied to the propeller shaft is transmitted to the outer cylinder via the first driving force transmitting member and the third driving force transmitting member. When the driving force transmitted to the propeller shaft is not less than the second driving force, the driving force applied to the propeller shaft is transmitted to the outer cylinder via the first driving force transmitting member, the second driving force transmitting member, and the third driving force transmitting member.

The first driving force transmitting member is thus not required to transmit a large driving force and thus mainly absorbs the shift shock and other impacts effectively. The second driving force transmitting member transmits the driving force applied to the propeller shaft when the driving force transmitted to the propeller shaft is large (high load state). Further, the third driving force transmitting member transmits the driving force when the driving force transmitted to the propeller shaft is not less than the first driving force and less than the second driving force and absorbs impacts acting on the propeller shaft. Thus, when the driving force transmitted to the propeller shaft becomes not less than the first driving force, the driving force applied to the propeller shaft is transmitted to the outer cylinder by the third driving force transmitting member in addition to the first driving force transmitting member. The load acting on the first driving force transmitting member is thus small, and the first driving force transmitting member can thus be formed of a soft material. The effect of absorbing the shift shock and other impacts by the first driving force transmitting member can thus be made high. When a large driving force that is not less than the second driving force is transmitted to the propeller shaft in accompaniment with shift switching, etc., the first driving force transmitting member deforms elastically and thereafter, the third driving force transmitting member deforms elastically. In this process, an impact, such as the shift shock, etc., is absorbed in at least two stages. One of the second engaging portions is thus undergoes so-called soft landing on the other second engaging portion. The impact that occurs when the pair of second engaging portions contact each other is thus small.

The first driving force is less than the critical load of the first driving force transmitting member and less than the critical load of the third driving force transmitting member. The first driving force transmitting member and the third driving force transmitting member can thus be made of soft materials to increase the impact absorbing effects of the first driving force transmitting member and the third driving force transmitting member, and yet breakage of the first driving force transmitting member and the third driving force transmitting member can be prevented.

A plurality of the third driving force transmitting members may be provided. Further, the driving force applied to the propeller shaft when the pair of third engaging portions contact each other may differ mutually among the plurality of third driving force transmitting members. An impact acting on the propeller shaft can thereby be absorbed in a stepwise manner by the plurality of third driving force transmitting members.

Preferably, the pair of third engaging portions include a third protrusion provided on the outer cylinder and arranged to protrude inward from the inner circumferential surface of the outer cylinder, and a third groove. The third groove includes a pair of side surfaces provided in the third driving force transmitting member and opposing each other in a circumferential direction of the outer cylinder, and arranged such that the third protrusion is inserted between the pair of side surfaces. Further, the third groove is arranged such that gaps are provided between the third protrusion and the respective side surfaces when a driving force is not transmitted to the propeller shaft, and the third groove is arranged such that the third protrusion is made to contact one of the pair of side surfaces by elastic deformation of the first driving force transmitting member when a driving force that is not less than the first driving force less than the reference driving force is transmitted to the propeller shaft.

According to this arrangement, when the driving force that is not less than the first driving force is transmitted to the propeller shaft, the large driving force can be transmitted by the pair of third engaging portions by contact of the third protrusion and one of the pair of side surfaces of the third groove.

Preferably, a spring constant of the third driving force transmitting member is greater than a spring constant of the first driving force transmitting member.

According to this arrangement, the driving force that the third driving force transmitting member can transmit from the inner cylinder to the outer cylinder can be made greater. The driving force that the first driving force transmitting member must transmit from the inner cylinder to the outer cylinder can be decreased correspondingly, and the first driving force transmitting member can thus be made softer.

Further preferably, the third protrusion and the third groove are arranged such that a gap between one side surface of the third groove and the third protrusion and a gap between the other side surface of the third groove and the third protrusion are equal when a driving force is not transmitted to the propeller shaft.

According to this arrangement, actions of the third driving force transmitting member can be made equivalent in the case where the propeller shaft rotates in one direction and the case where the propeller shaft rotates in another direction. That is, the third driving force transmitting member can exhibit the function of transmitting the driving force of the propeller shaft and the function of absorbing the impact of the propeller shaft equivalently in respective cases of rotation of the propeller shaft in either rotation direction.

Further preferably, the third protrusion includes a plurality of spline teeth each arranged to extend in the axial direction. The third groove includes a plurality of spline grooves each arranged to extend in the axial direction. The spline teeth are arranged at equal intervals in a circumferential direction of the outer cylinder. The spline grooves are arranged at equal intervals in the circumferential direction of the outer cylinder.

According to this arrangement, the driving force that can be transmitted from the third driving force transmitting member to the outer cylinder can be made large. The driving force that the first driving force transmitting member must transmit when the second driving force transmitting member is not transmitting the driving force to the outer cylinder can thus be made small. The first driving force transmitting member can thus be made softer. The third driving force transmitting member is engaged with the outer cylinder at a plurality of locations along its circumferential direction. The third driving force transmitting member thus deforms elastically substantially uniformly as a whole when absorbing the impact of the propeller shaft. The impact absorbing effect is thereby improved and the third driving force transmitting member can be made long in life.

In a preferred embodiment of the present invention, the first protrusion includes a plurality of spline teeth each arranged to extend in the axial direction. The first groove includes a plurality of spline grooves each arranged to extend in the axial direction. The spline teeth are arranged at equal intervals in a circumferential direction of the outer cylinder. The spline grooves are arranged at equal intervals in the circumferential direction of the outer cylinder.

According to this arrangement, the first driving force transmitting member is coupled to the outer cylinder at a plurality of locations in the circumferential direction, and thus the force of coupling with the outer cylinder is strong. The first driving force transmitting member can thereby be prevented from slipping with respect to the outer cylinder or breaking. The impact absorbing function and the driving force transmitting function of the first driving force transmitting member can thus be improved.

In this case, position of the spline teeth of the first protrusions and the position of the spline teeth of the third protrusions may be matched in the circumferential direction. A single spline tooth located on the outer cylinder can thereby be used as the spline tooth of the first protrusion and the spline tooth of the third protrusion. Manufacture of the propeller unit that includes the first spline tooth and the third spline tooth is thus facilitated.

In a preferred embodiment of the present invention, a plurality of the second protrusions are arranged at equal intervals in the circumferential direction and a plurality of the second grooves are arranged at equal intervals in the circumferential direction.

According to this arrangement, a distribution of the driving force transmitted from the second driving force transmitting member to the outer cylinder can be made uniform in the circumferential direction.

In a preferred embodiment of the present invention, the second protrusion includes a tooth located on an outer circumference of the second driving force transmitting member, and the second groove includes a notch located on an end surface of the outer cylinder.

According to this arrangement, the second groove can be simply arranged in which a notch is provided in a rear surface of the outer cylinder. The second protrusion can be inserted readily into the second groove from the rear of the second groove, and assembly of the propeller unit is thus made easy.

Preferably, in this case, the tooth includes a first tooth having a predetermined width in the circumferential direction and a second tooth having a width in the circumferential direction narrower than the width of the first tooth. The notch includes a first notch longer in the circumferential direction than the first tooth and a second notch narrower in the circumferential direction than the first tooth. The first tooth is inserted in the first notch. The second tooth is inserted in the second notch.

According to this arrangement, when the driving force transmitted to the propeller shaft is not less than the reference driving force (second driving force), the driving force of the propeller shaft can be transmitted from the inner cylinder to the outer cylinder by engaging of the first tooth and the first notch and engaging of the second tooth and the second notch. Moreover, the width of the second notch is made narrower than the width of the first tooth, and erroneous insertion of the first tooth in the second notch can thus be prevented. The teeth and the notches can thereby be engaged in the designed manner.

In a preferred embodiment of the present invention, the second protrusion and the second groove are arranged such that a gap between one side surface of the second groove and the second protrusion and a gap between the other side surface of the second groove and the second protrusion are equal when a driving force is not transmitted to the propeller shaft.

According to this arrangement, the operation of the second driving force transmitting member can be made equivalent in the case where the propeller shaft rotates in one direction and the case where the propeller shaft rotates in the other direction.

In a preferred embodiment of the present invention, the outer cylinder includes an external cylinder integral to the blades, and an internal cylinder provided at an inner side of the external cylinder and arranged to define the inner circumferential surface of the outer cylinder.

According to this arrangement, a space between the external cylinder and the internal cylinder can be used, for example, as a passage for exhaust from an engine that drives the propeller shaft. A propeller unit for marine vessel propulsion device according to a preferred embodiment of the present invention is arranged such that an impact absorbing function is mainly borne by the first driving force transmitting member and a driving force transmission is mainly borne by the second driving force transmitting member. Such an impact absorbing structure and driving force transmission structure can be housed within a narrow space at an inner side of the internal cylinder.

A marine vessel propulsion device according to a preferred embodiment of the present invention includes an engine, a driveshaft arranged to be rotated by the engine, and a drive gear fixed to the driveshaft. The marine vessel propulsion device includes a forward drive gear arranged to engage with the drive gear, a reverse drive gear arranged to engage with the drive gear and arranged to rotate in an opposite direction of the forward drive gear, and a dog clutch arranged to selectively engage with the forward drive gear and the reverse drive gear. The marine vessel propulsion device includes a propeller shaft arranged to rotate together with the dog clutch, and a propeller unit coupled to the propeller shaft. The propeller unit includes an inner cylinder fixed to the propeller shaft, an outer cylinder having a cylindrical shape coaxial with the inner cylinder and including blades fixed on an outer circumferential surface of the outer cylinder, a first driving force transmitting member including a cylindrical elastic member arranged between the inner cylinder and the outer cylinder, and a second driving force transmitting member arranged between the inner cylinder or the propeller shaft and the outer cylinder and aligned with the first driving force transmitting member in an axial direction of the outer cylinder. The propeller unit further includes a pair of first engaging portions arranged on the outer cylinder and the first driving force transmitting member and arranged to mutually engage such that a driving force is transmittable to each other, and a pair of second engaging portions arranged on the outer cylinder and the second driving force transmitting member. The pair of second engaging portions are arranged such that a mutual engaging of the respective second engaging portions is disengaged when a driving force is not transmitted to the propeller shaft. The pair of second engaging portions are arranged such that the respective second engaging portions become mutually engaged in a driving force transmittable manner by elastic deformation of the first driving force transmitting member when a driving force that is not less than a reference driving force not exceeding a critical load of the first driving force transmitting member is transmitted to the propeller shaft.

According to this arrangement, a marine vessel propulsion device can be provided with which shift shock and other impacts acting on the propeller shaft can be prevented, the driving force from the propeller shaft can be transmitted to the blades, and impact noise during travel through a rocky reef region can be prevented and minimized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention shall now be described in detail with reference to the attached drawings.

Figure 1:
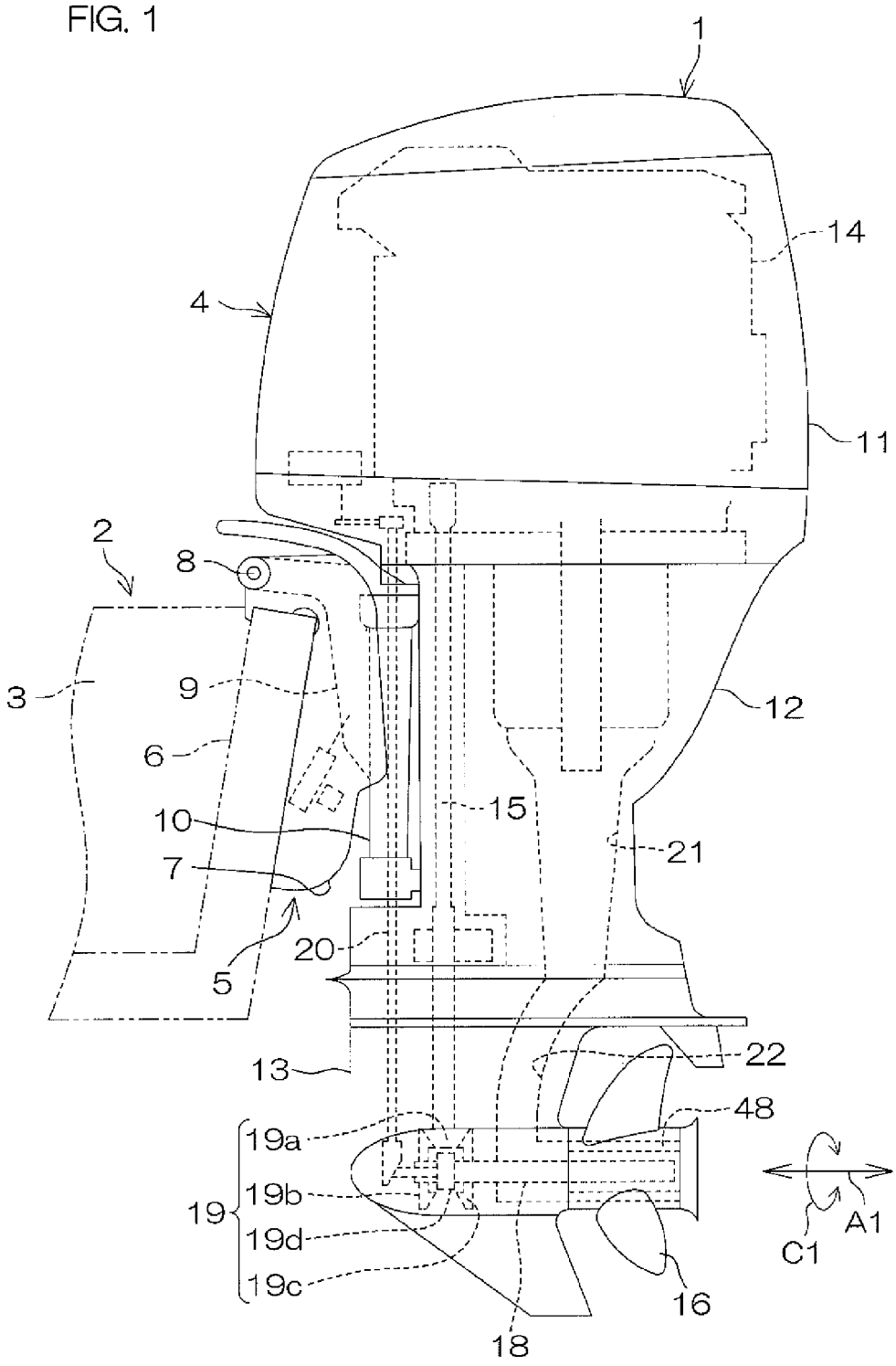
FIG. 1 is a schematic side view of a general arrangement of an outboard motor according to a preferred embodiment of the present invention.

FIG. 1 is a schematic side view of a general arrangement of an outboard motor according to a preferred embodiment of the present invention.

The outboard motor 1 is an example of a "marine vessel propulsion device" according to the present preferred embodiment of the present invention. The outboard motor 1 is used upon attachment to a stern (transom) of a hull 3 of a marine vessel 2 and generates a propulsive force that drive the marine vessel 2 forward or in reverse. The outboard motor 1 includes an outboard motor main body 4, and an attachment mechanism 5 arranged to attach the outboard motor main body 4 to the hull 3.

The attachment mechanism 5 includes a clamp bracket 7 detachably fixed to a stern plate 6 of the hull 3, and a swivel bracket 9 coupled to the clamp bracket 7 in a manner enabling pivoting about a tilt shaft 8 as a horizontal pivot axis. The outboard motor main body 4 is attached to the swivel bracket 9 in a manner enabling pivoting about a steering shaft 10.

The outboard motor main body 4 has a housing which includes an engine cover 11, an upper case 12, and a lower case 13. An engine 14 is provided as a drive source inside the engine cover 11 with an axis of a crankshaft of the engine 14 arranged to extend vertically. A driveshaft 15 for power transmission is coupled to a lower end of the crankshaft of the engine 14. The driveshaft 15 extends vertically through the upper case 12 and into the lower case 13.

A propeller shaft 18 extends horizontally in the lower case 13. A propeller unit 16 is coupled to a rear end of the propeller shaft 18. A rotation of the driveshaft 15 is transmitted to the propeller shaft 18 via a shift mechanism 19 that serves as a clutch mechanism. The propeller unit 16 is an example of a "propeller unit for marine vessel propulsion device" according to a preferred embodiment of the present invention and is driven to rotate together with the propeller shaft 18.

In the description of the present preferred embodiment, upper, lower, front, rear, left, and right sides of the outboard motor 1 are defined in accordance with upper, lower, front, rear, left, and right sides of the hull 2 on the basis of an attitude of the outboard motor 1 when the propeller shaft 18 is in a horizontal attitude in which the propeller shaft 18 extends along a central line of the hull 2 (attitude shown in FIG. 1).

The shift mechanism 19 includes a drive gear 19*a*, arranged from a beveled gear fixed to a lower end of the driveshaft 15. Further, the shift mechanism 19 includes a forward drive gear 19*b*, arranged from a beveled gear rotatably disposed on the propeller shaft 18, and a reverse drive gear 19*c*, arranged from a beveled gear likewise rotatably disposed on the propeller shaft 18. The shift mechanism 19 further includes a dog clutch 19*d* arranged between the forward drive gear 19*b* and the reverse drive gear 19*c*.

The forward drive gear 19*b* is engaged with the drive gear 19*a* from a forward side, and the reverse drive gear 19*c* is engaged with the drive gear 19*a* from a rear side. The forward drive gear 19*b* and the reverse drive gear 19*c* thus rotate in mutually opposite directions.

The dog clutch 19*d* is spline-connected to the propeller shaft 18. That is, the dog clutch 19*d* is arranged to slide with respect to the propeller shaft 18 in the axial direction of the shaft but is not rotatable relative to the propeller shaft 18 and rotates together with the propeller shaft 18.

The dog clutch 19*d* is arranged to slide on the propeller shaft 18 by axial rotation of a shift rod 20 that extends vertically and in parallel to the driveshaft 15. The dog clutch 19*d* is thereby controlled to be set at a shift position among a forward drive position of being coupled to the forward drive gear 19*b*, a reverse drive position of being coupled to the reverse drive gear 19*c*, and a neutral position of not being coupled to either the forward drive gear 19*b* or the reverse drive gear 19*c*.

When the dog clutch 19*d* is at the forward drive position, the rotation of the forward drive gear 19*b* is transmitted to the propeller shaft 18 via the dog clutch 19*d*. The propeller unit 16 is thereby rotated in one direction (forward drive direction) to generate a propulsive force in a direction of driving the hull 2 forward. On the other hand, when the dog clutch 19*d* is at the reverse drive position, the rotation of the reverse drive gear 19*c* is transmitted to the propeller shaft 18 via the dog clutch 19*d*. The reverse drive gear 19*c* is rotated in a direction opposite that of the forward drive gear 19*b*, and the propeller unit 16 is thus rotated in an opposite direction (reverse drive direction) to generate a propulsive force in a direction of driving the hull 2 in reverse. When the dog clutch 19*d* is in the neutral position, the rotation of the driveshaft 15 is not transmitted to the propeller shaft 18. That is, a driving force transmission path between the engine 14 and the propeller unit 16 is interrupted such that a propulsive force is not generated in any direction.

The engine 14 is, for example, a multi-cylinder, four-cycle engine. The driveshaft 15 is rotated by rotation of the crankshaft of the engine 14. An exhaust passage 21 that guides an exhaust gas of the engine 14 from the engine 14 to the lower case 13 is arranged in an interior of the upper case 12. An exhaust relay passage 22 is arranged in an interior of the lower case 13. The exhaust relay passage 22 is connected to a lower end of the exhaust passage 21. The exhaust gas that has passed through the exhaust relay passage 22 is arranged to be exhausted underwater through an exhaust port 48 in an interior of the propeller unit 16.

Figure 2:
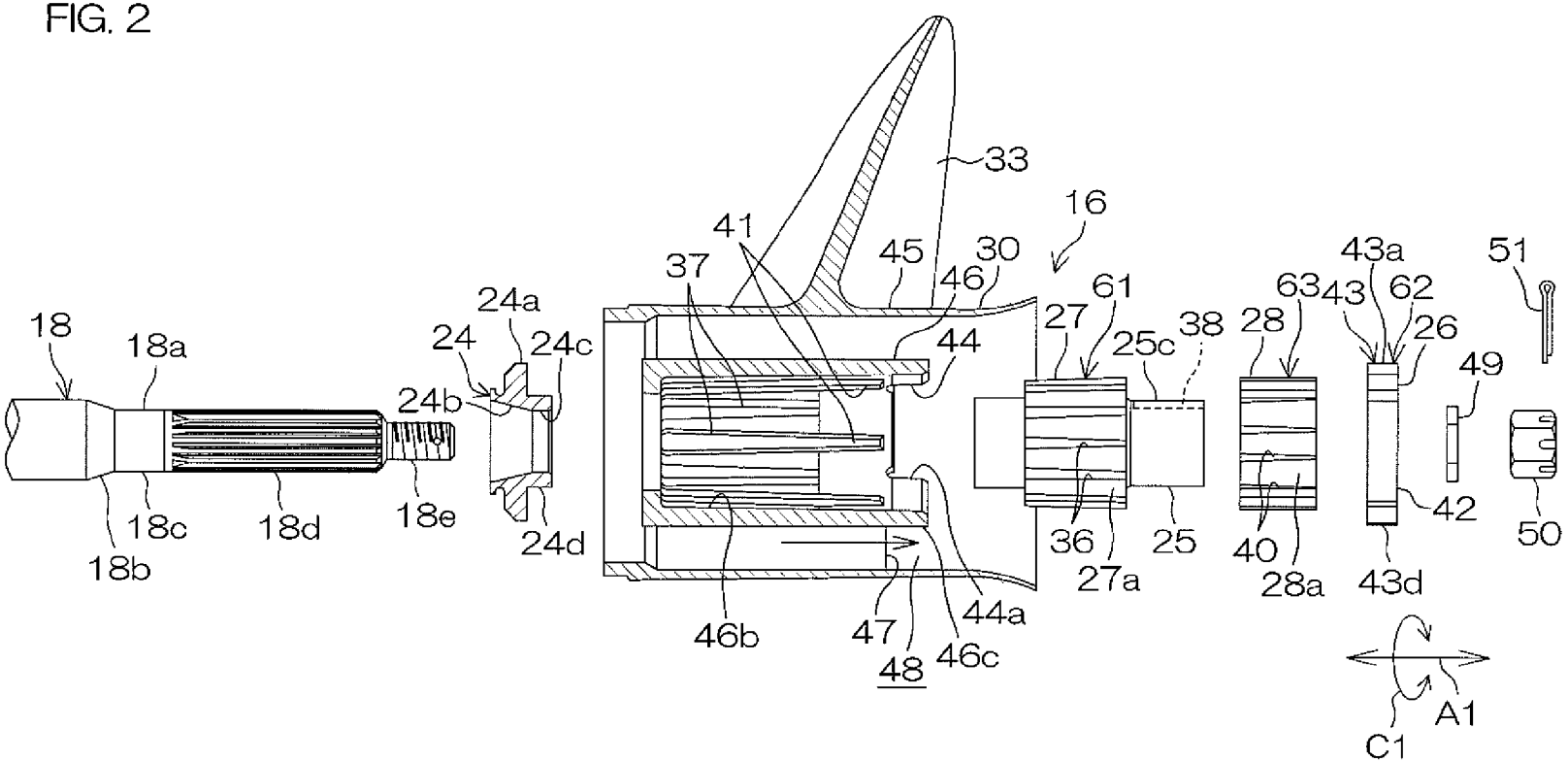
FIG. 2 is an exploded side view, partially in section, of a propeller shaft.

FIG. 2 is an exploded side view, partially in section, of the propeller unit 16. A rear portion 18*a* of the propeller shaft 18 includes a tapered portion 18*b* arranged to be tapered off toward the rear, a cylindrical portion 18*c* arranged to extend rearward from the tapered portion 18*b*, a spline shaft 18*d* arranged to extend to the rear from the cylindrical portion 18*c*, and a male thread portion 18*e* arranged to extend to the rear from the spline shaft 18*d*.

Figure 3:
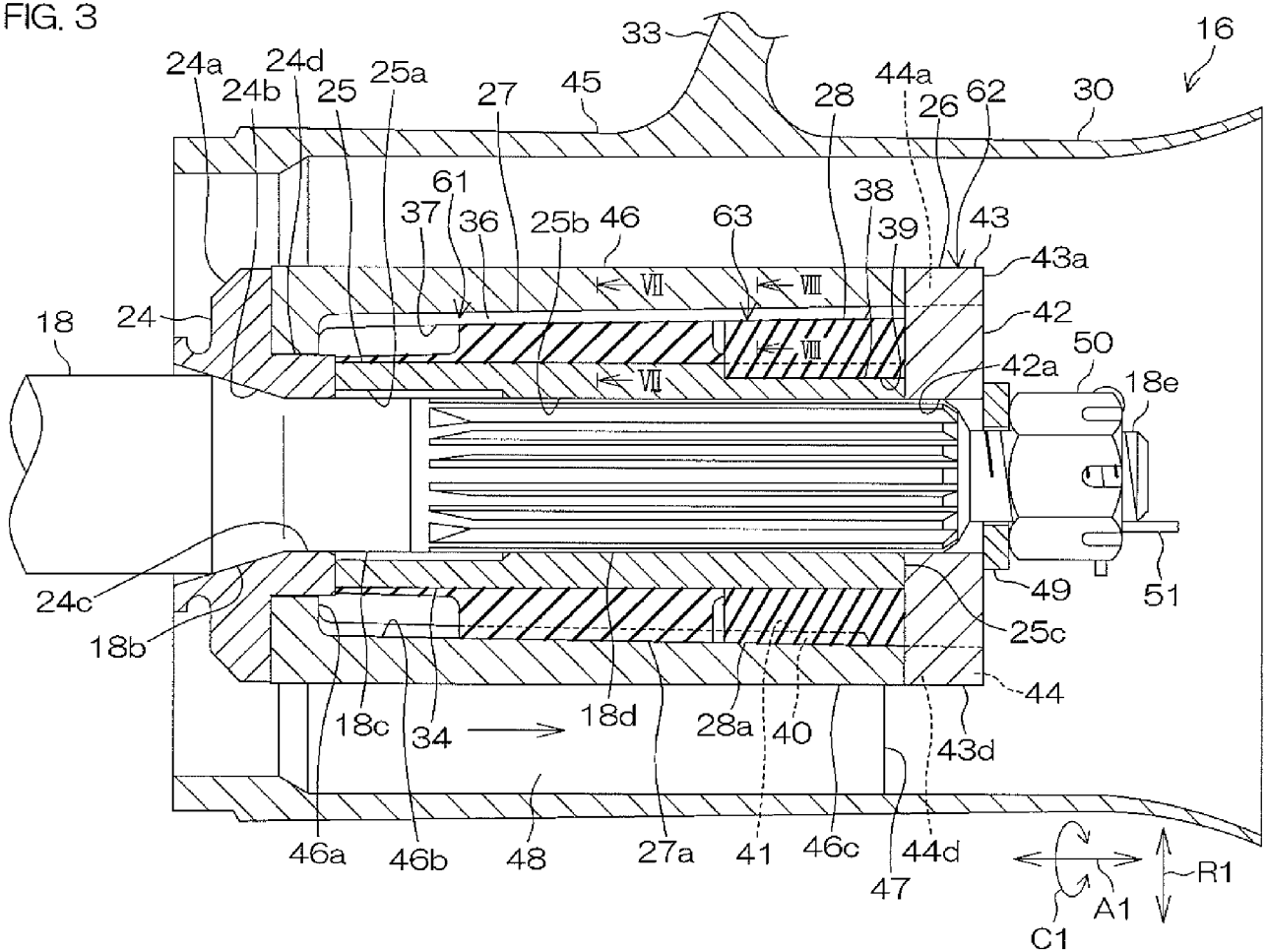
FIG. 3 is a sectional view of a propeller unit coupled to the propeller shaft.

FIG. 3 is a sectional view of the propeller unit 16 coupled to the propeller shaft 18. The propeller unit 16 includes a first spacer 24, into which the tapered portion 18*b* and the cylindrical portion 18*c* of the propeller shaft 18 are inserted, and an inner cylinder 25 and a second spacer 26, into which the spline shaft 18*d* of the propeller shaft 18 is inserted. The propeller unit 16 further includes a main damper 27 and a sub damper 28 that are coupled to the inner cylinder 25. The propeller unit 16 includes an outer cylinder 30 that coaxially surrounds the first spacer 24, the second spacer 26, the main damper 27, and the sub damper 28, and a plurality of blades 33 fixed to the outer cylinder 30.

Unless described otherwise in particular, the following description shall be based on a state in which a driving force is not acting on the propeller shaft 18.

The first spacer 24 is preferably a member made of brass or other metal. The first spacer 24 is arranged at a front end of the propeller unit 16. The first spacer 24 preferably has a cylindrical shape having an annular flange 24*a* at an outer circumference. An inner circumferential surface of the first spacer 24 includes a tapered portion 24*b*, into which the tapered portion 18*b* of the propeller shaft 18 is inserted, and a cylindrical portion 24*c*, arranged to extend to the rear from the tapered portion 24*b* and into which the cylindrical portion 18*c* of the propeller shaft 18 is inserted. An outer circumferential surface of the first spacer 24 includes a cylindrical surface 24*d* arranged to extend rearward from the annular flange 24*a*.

The inner cylinder 25 and the main damper 27 are integrated and define a single unit 34. The inner cylinder 25 is preferably a member made of brass or other metal. The inner cylinder 25 preferably has a cylindrical shape and arranged to extend in an axial direction A1 of the propeller unit 16. The inner cylinder 25 is coupled to the propeller shaft 18 in a manner disabling relative rotation and is arranged to rotate integrally with the propeller shaft 18.

An inner circumferential surface of the inner cylinder 25 includes a large diameter portion 25*a* arranged at a front portion of the inner cylinder 25, and a spline hole 25*b* arranged to extend to the rear from the large diameter portion 25*a*. The large diameter portion 25*a* surrounds the cylindrical portion 18*c* and a front portion of the spline shaft 18*d* of the propeller shaft 18. The spline hole 25*b* of the inner cylinder 25 is fixed to the spline shaft 18*d* and made integrally rotatable with the spline shaft 18*d* by being spline-connected to the spline shaft 18*d*.

The main damper 27 is an example of a "first driving force transmitting member" according to a preferred embodiment of the present invention. The main damper 27 has a function of relaxing shift shock and other impacts applied to the propeller shaft 18. Further, the main damper 27 has a function of transmitting the driving force from the inner cylinder 25 to the outer cylinder 30 when the driving force transmitted to the propeller shaft 18 is less than a predetermined first driving force. The main damper 27 is a cylindrical, integrally-molded item formed using an elastic member made of natural rubber, etc. The main damper 27 is joined by cure-adhesion, etc., to an outer circumferential surface of the inner cylinder 25 and is arranged between the inner cylinder 25 and the outer cylinder 30.

Figure 4A:
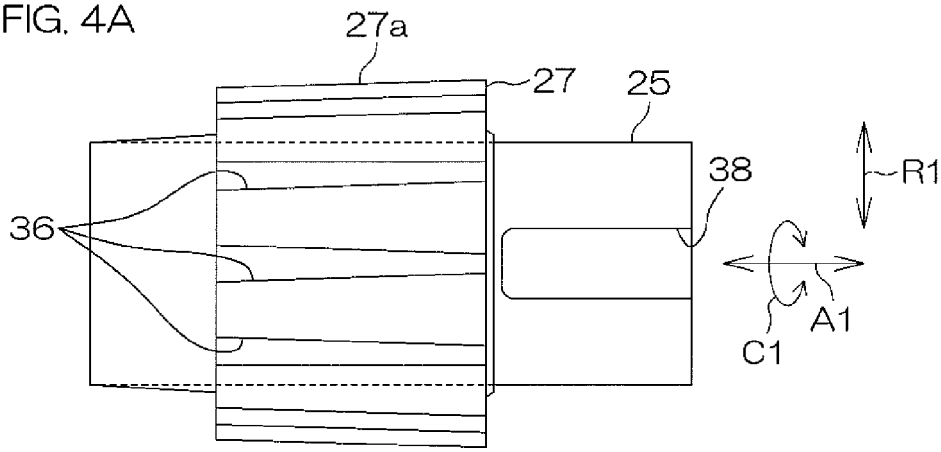
FIG. 4A is a side view of a unit including an inner cylinder and a main damper.
Figure 4B:
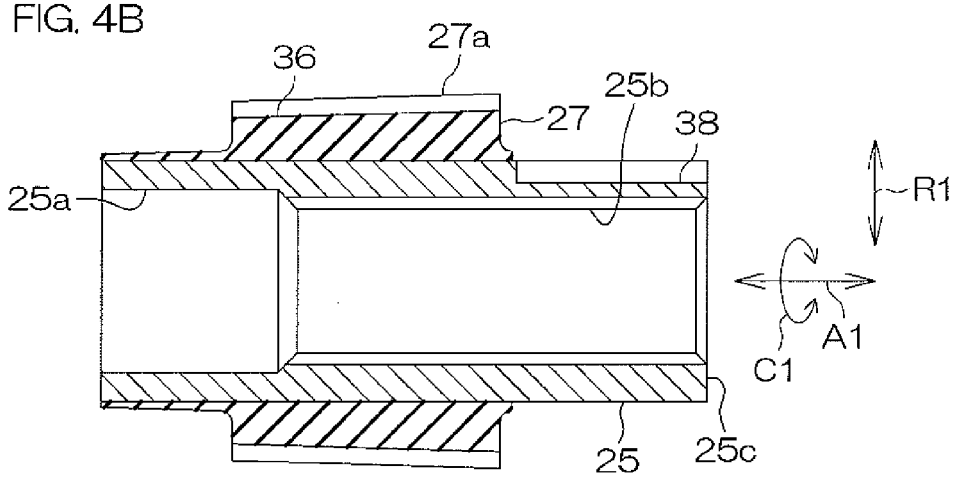
FIG. 4B is a longitudinal sectional view of the unit taken along an axial direction of the propeller unit.
Figure 4C:
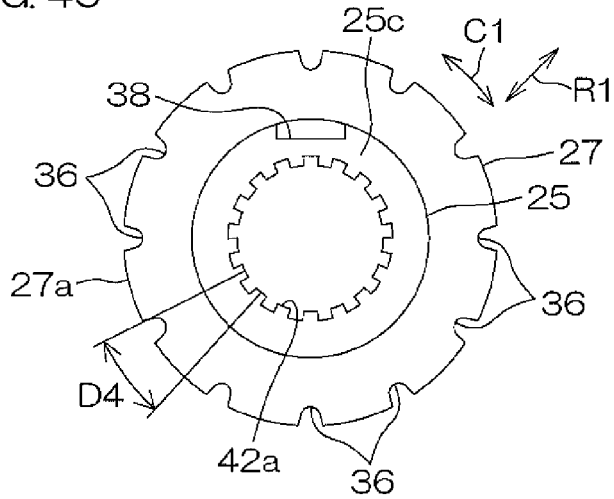
FIG. 4C is a rear view of the unit as viewed from a rear of the propeller unit.

FIG. 4A is a side view of the unit 34, FIG. 4B is a longitudinal sectional view of the unit 34 taken along the axial direction A1 of the propeller unit 16, and FIG. 4C is a rear view of the unit 34 as viewed from a rear of the propeller unit 16. As shown in FIG. 4B, an outer circumferential surface 27*a* of the main damper 27 preferably has a tapered shape as a whole and increases in diameter toward the rear. As shown in FIG. 4A and FIG. 4C, first spline grooves 36, arranged to extend in the axial direction A1 of the propeller unit 16, are provided in the outer circumferential surface 27*a* of the main damper 27. The first spline grooves 36 are an example of a "first groove" according to a preferred embodiment of the present invention. Each first spline groove 36 is preferably arranged to extend across an entire length of the main damper 27 in the axial direction A1 of the propeller unit 16 and narrows in groove width toward the rear. A plurality (for example, twelve) of the first spline grooves 36 are arranged at equal intervals in a circumferential direction C1 of the propeller unit 16.

At the rear of the main damper 27, a single key groove 38 is arranged in a rear portion 25*c* of the inner cylinder 25. The key groove 38 is arranged in the outer circumferential surface of the inner cylinder 25 and extends in the axial direction A1 of the propeller unit 16. The key groove 38 is opened at a rear end of the inner cylinder 25. The sub damper 28 is attached to the rear portion 25*c* that includes the key groove 38.

Figure 5:
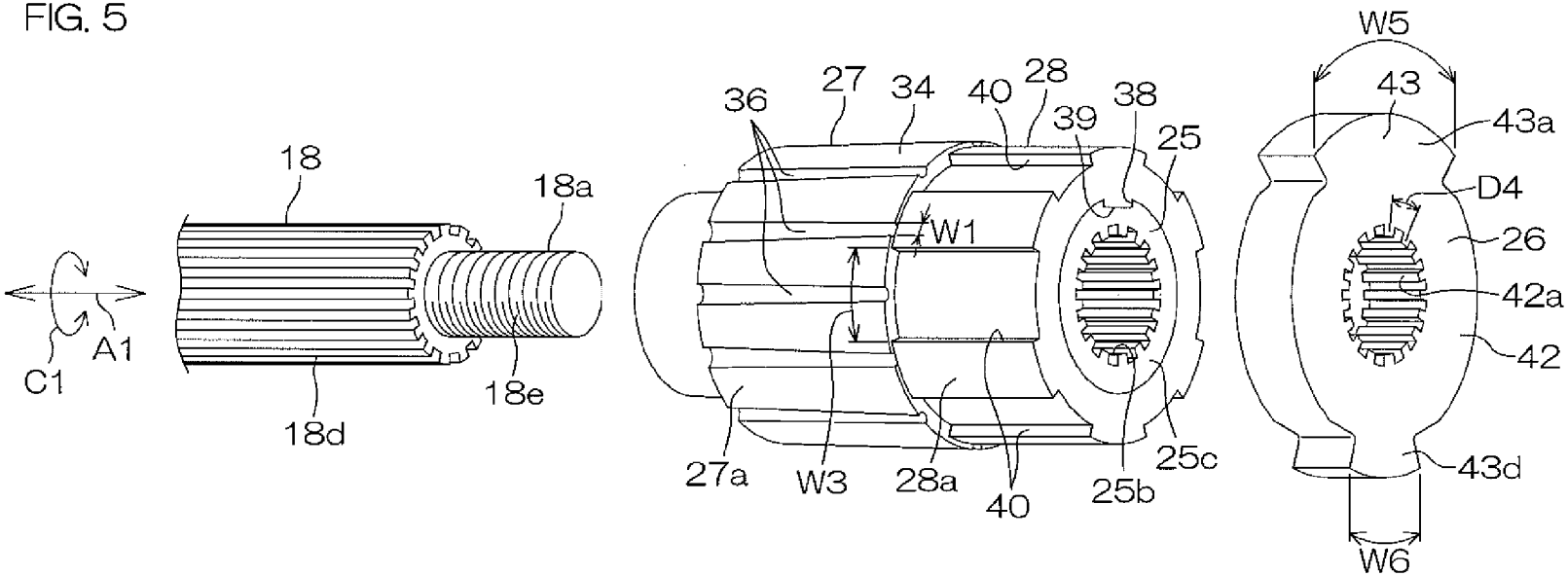
FIG. 5 is a perspective view of the propeller shaft, the unit, a sub damper, and a second spacer.

FIG. 5 is a perspective view of the propeller shaft 18, the unit 34, the sub damper 28, and the second spacer 26. The sub damper 28 is an example of a "third driving force transmitting member" in the present preferred embodiment of the present invention and is disposed to the rear of the main damper 27. The sub damper 28 has a function of relaxing shift shock and other impacts applied to the propeller shaft 18. The sub damper 28 further has a function of transmitting the driving force, from the inner cylinder 25 to the outer cylinder 30 when the driving force transmitted to the propeller shaft 18 is not less than the predetermined first driving force and less than a predetermined second driving force. The second driving force is a driving force that is greater than the first driving force. The second driving force is an example of a "reference driving force" according to a preferred embodiment of the present invention.

The sub damper 28 preferably is a cylindrical, integrally-molded item formed using an elastic member made of natural rubber, etc. The sub damper 28 has a spring constant that is greater than a spring constant of the main damper 27. The sub damper 28 is thus harder than the main damper 27.

A key 39, which is inserted into the key groove 38 of the inner cylinder 25, is formed on an inner circumferential surface of the sub damper 28. The sub damper 28 has the key 39 inserted in the key groove 38 and the rear portion 25*c* of the inner cylinder 25 is inserted into the inner circumferential surface of the sub damper 28. The sub damper 28 and the inner cylinder 25 are thereby coupled in a manner disabling relative rotation. The sub damper 28 is arranged between the inner cylinder 25 and the outer cylinder 30.

An outer diameter of the outer circumferential surface 28*a* of the sub damper 28 is substantially the same at all positions in the axial direction A1 and is slightly less than the outer diameter of the rear end of the outer circumferential surface 27*a* of the main damper 27. Third spline grooves 40, arranged to extend in the axial direction A1 of the propeller unit 16, are formed in the outer circumferential surface 28*a* of the sub damper 28. The third spline grooves 40 are an example of a "third groove" according to a preferred embodiment of the present invention. Each third spline groove 40 is preferably arranged to extend across an entire length of the sub damper 28 in the axial direction A1 of the propeller unit 16 and is substantially the same in groove width at all positions in the axial direction A1. The groove width W3 of the third spline grooves 40 is wider than the groove width (minimum groove width) W1 of the first spline grooves 36.

A plurality of the third spline grooves 40 are arranged at equal intervals in the circumferential direction C1 of the propeller unit 16. The number of the third spline grooves 40 is less than the number of the first spline grooves 36. In the present preferred embodiment of the present invention, the number of the third spline grooves 40 preferably is half (six) the number of the first spline grooves 36. In the circumferential direction C1 of the propeller unit 16, central positions of the third spline grooves 40 are matched with central positions of the corresponding first spline grooves 36.

The second spacer 26 is an example of a "second driving force transmitting member" according to a preferred embodiment of the present invention. The second spacer 26 is arranged between the inner cylinder 25 and the outer cylinder 30 at the rear of the main damper 27 and the sub damper 28. The second spacer 26 can also be said to be arranged between the propeller shaft 18 and the outer cylinder 30. The sub damper 28 is sandwiched by the second spacer 26 and the main damper 27 in the axial direction A1 of the propeller unit 16. The second spacer 26 is arranged so as not to transmit the driving force of the propeller shaft 18 to the outer cylinder when the driving force of the propeller shaft 18 is less than the second driving force. The second spacer 26 is arranged to transmit the driving force of the propeller shaft 18 to the outer cylinder when the driving force of the propeller shaft 18 is not less than the second driving force.

The second spacer 26 is preferably a member made of stainless steel or other metal. The second spacer 26 includes a disk-shaped spacer main body 42 arranged to have a spline hole 42*a* formed in a center of the spacer main body 42, and teeth 43 arranged to protrude from an outer circumference of the spacer main body 42. The spline shaft 18*d* of the propeller shaft 18 is inserted in the spline hole 42*a*. The second spacer 26 is thereby spline-connected to the propeller shaft 18. The second spacer 26 rotates integrally with the propeller shaft 18.

A length of the spline hole 42*a* is preferably set according to a maximum driving force transmitted to the propeller shaft 18. The driving force from the propeller shaft 18 can thereby be received by the second spacer 26. If the second spacer 26 is increased in thickness to increase the length of the spline hole 42*a*, a total length of the inner cylinder 25 is shortened correspondingly. The strength of the second spacer 26 can thereby be increased without changing the propeller shaft 18.

The teeth 43 of the second spacer 26 are an example of a "second protrusion" according to a preferred embodiment of the present invention. In the present preferred embodiment of the present invention, a plurality (two) of the teeth 43 of the second spacer 26 are provided and disposed at equal intervals in the circumferential direction C1 of the propeller unit 16. The teeth 43 of the second spacer 26 include a first tooth 43*a* arranged to have a predetermined width W5 in the circumferential direction C1 of the propeller unit 16 and a second tooth 43*d* arranged to have a width W6 that is narrower than the first tooth 43*a*.

Figure 6:
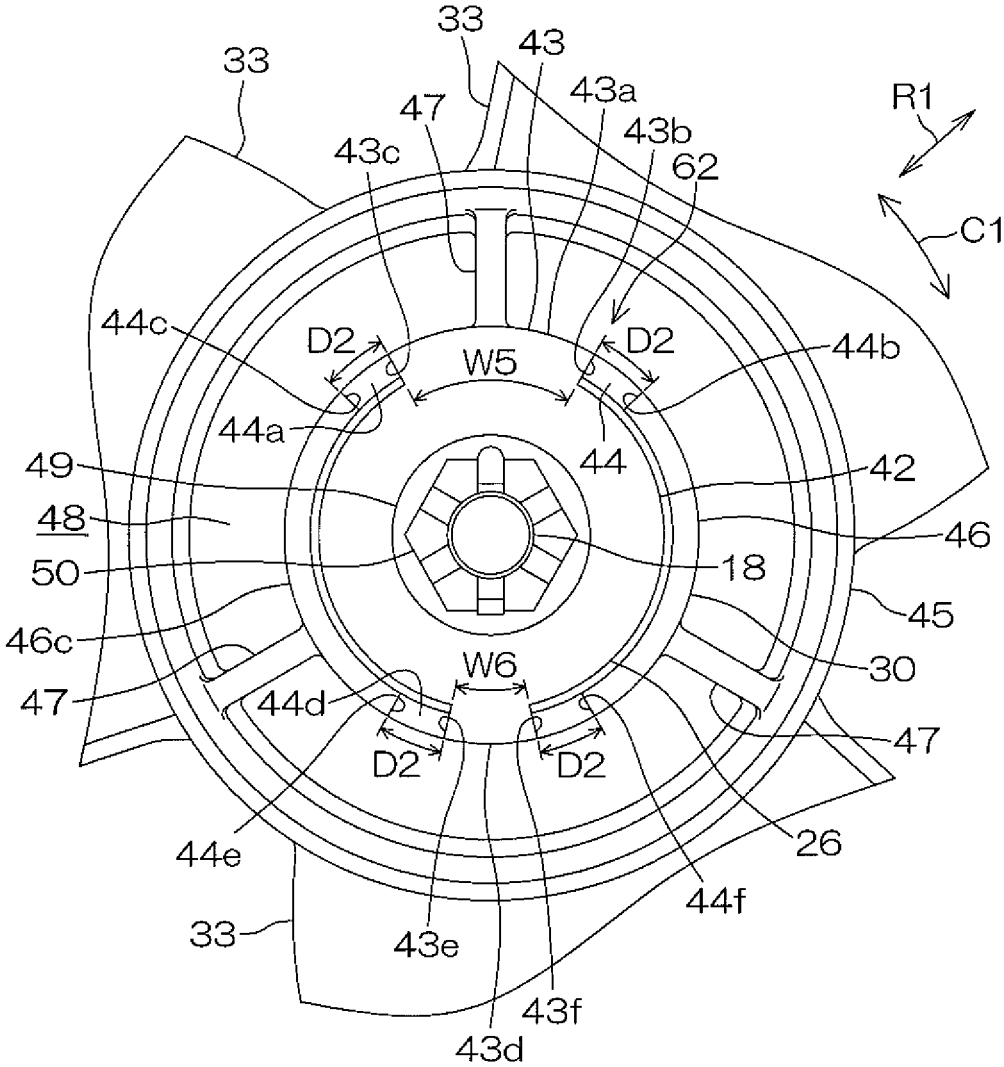
FIG. 6 is a view of the propeller unit as viewed from the rear.

FIG. 6 is a view of the propeller unit 16 as viewed from the rear of the propeller unit 16. The outer cylinder 30 is preferably a member made of stainless steel or other metal and preferably has a cylindrical shape that is coaxial to the inner cylinder 25. The outer cylinder 30 includes an external cylinder 45 that is made integral with the blades 33, an internal cylinder 46 arranged coaxially at an inner side of the external cylinder 45, and a plurality of ribs 47 arranged to connect the external cylinder 45 and the internal cylinder 46. The blades 33 are fixed to an outer circumferential surface of the external cylinder 45. The axial direction A1, the circumferential direction C1, and a radial direction R1 of the propeller unit 16 respectively correspond to the axial direction, circumferential direction, and radial direction of the internal cylinder 46.

The ribs 47 are provided at a plurality of locations (for example, three locations) at equal intervals in the circumferential direction C1. Each rib 47 has one end fixed to the external cylinder 45 and has the other end fixed to the internal cylinder 46. The exhaust port 48 is thereby located between the external cylinder 45 and the internal cylinder 46. The exhaust port 48 communicates with the exhaust relay passage 22 of the lower case 13 (see FIG. 1). The exhaust gas from the exhaust relay passage 22 is exhausted underwater through the exhaust port 48.

As shown in FIG. 3, the internal cylinder 46 of the outer cylinder 30 is arranged to be shorter than the external cylinder 45 in the axial direction A1 and is arranged inside the external cylinder 45. An annular flange 46*a* arranged to protrude inward in the radial direction R1 of the propeller unit 16 is provided at a front end of the internal cylinder 46 of the outer cylinder 30. The annular flange 46*a* is inserted in a cylindrical surface 24*d* of the first spacer 24 and is received by a rear surface of the annular flange 24*a*.

As shown in FIG. 2, an inner circumferential surface 46*b* of the internal cylinder 46 of the outer cylinder 30 is arranged to a tapered shape that increases in diameter toward the rear. First spline teeth 37 and third spline teeth 41 arranged to extend in the axial direction A1 and protruding inward from the inner circumferential surface 46*b* of the internal cylinder 46 are provided on the inner circumferential surface 46*b* of the internal cylinder 46. Notches 44 are provided in an end surface of a rear end portion 46*c* of the internal cylinder 46.

The first spline teeth 37 are an example of a "first protrusion" according to a preferred embodiment of the present invention. A pair of first engaging portions 61 are defined by the first spline teeth 37 and the first spline grooves 36. The same number (twelve) of the first spline teeth 37 as the number of the first spline grooves 36 of the main damper 27 are provided and the first spline teeth 37 are arranged at equal intervals in the circumferential direction C1 of the propeller unit 16. Each first spline tooth 37 is arranged to be tapered off toward the rear.

The third spline teeth 41 are an example of a "third protrusion" according to a preferred embodiment of the present invention. A pair of third engaging portions 63 are provided by the third spline teeth 41 and the third spline grooves 40. The same number (six) of the third spline teeth 41 as the number of the third spline grooves 40 of the sub damper 28 are provided and the third spline teeth 41 are arranged at equal intervals in the circumferential direction C1. Each third spline tooth 41 is arranged to be tapered off toward the rear. Each third spline tooth 41 is arranged adjacent to the rear of the first spline tooth 37 and is integral with the corresponding first spline tooth 37. Each third spline tooth 41 and the corresponding first spline tooth 37 are matched in central position in the circumferential direction C1 of the propeller unit 16.

That is, short spline teeth and long spline teeth are arranged alternately on the inner circumferential surface 46*b* of the internal cylinder 46. The short spline teeth are defined by just the first spline teeth 37 and are arranged in a region opposing the main damper 27. The long spline teeth are arranged of the first spline teeth 37 and the third spline teeth 41 and are arranged across a region opposing not only the main damper 27 but also the sub damper 28.

As shown in FIG. 6, the notches 44 are arranged at an end surface of the rear end portion 46*c* of the internal cylinder 46. The notches 44 are an example of a "second groove" according to a preferred embodiment of the present invention. By engaging of the teeth 43 of the second spacer 26 with the notches 44, the driving force of the propeller shaft 18 is transmitted from the second spacer 26 to the internal cylinder 46. A pair of second engaging portions 62 are provided by the first teeth 43 and the notches 44.

A plurality (two) of the notches 44 are provided across an interval of 180 degrees in the circumferential direction C1 of the propeller unit 16. The notches 44 include a first notch 44*a* and a second notch 44*d*. The first notch 44*a* includes a pair of side surfaces 44*b* and 44*c* arranged to oppose each other in the circumferential direction C1 of the propeller unit 16. An interval between the pair of side surfaces 44*b* and 44*c* is wider than a tooth width W5 in the circumferential direction C1 of the first tooth 43*a* of the second spacer 26.

The second notch 44*d* includes a pair of side surfaces 44*e* and 44*f* arranged to oppose each other in the circumferential direction C1 of the propeller unit 16. An interval between the pair of side surfaces 44*e* and 44*f* is narrower than the tooth width W5 of the first tooth 43*a* of the second spacer 26 and wider than a tooth width W6 of the second tooth 43*d* of the second spacer 26.

As shown in FIG. 3, the main damper 27 is inserted into the internal cylinder 46 along the axial direction A1 and is detachably held by the internal cylinder 46. For example, the main damper 27 is arranged to be press-fitted into the internal cylinder 46 by a comparatively small force of approximately several hundred N. The respective first spline teeth 37 of the internal cylinder 46 are inserted in the corresponding first spline grooves 36 of the main damper 27. The manner of coupling is the same for the respective first spline teeth 37 and the first spline grooves 36, and thus in the following description, the coupling of a single first spline teeth 37 with a single first spline groove 36 shall be described.

Figure 7:
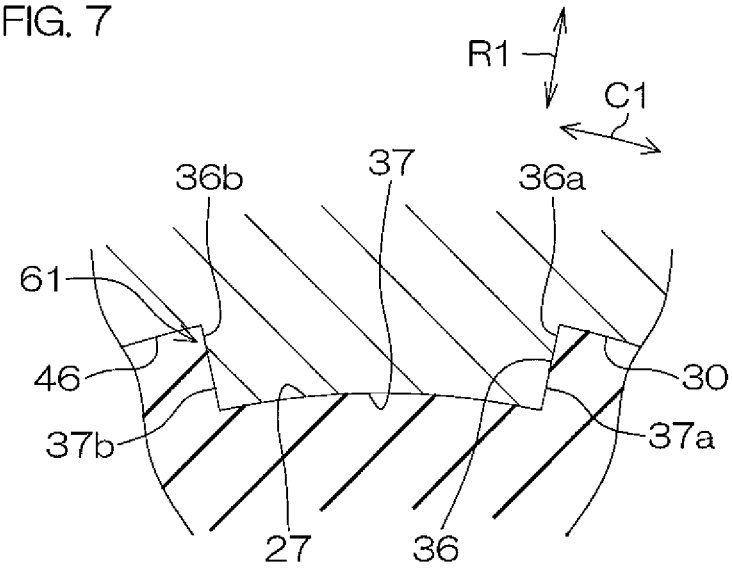
FIG. 7 is a sectional view taken along line VII-VII in FIG. 3.

As shown in FIG. 7, which is a sectional view taken along line VII-VII in FIG. 3, a pair of side surfaces 37*a* and 37*b* of the first spline tooth 37 are respectively in constant, gapless contact with a pair of side surfaces 36*a* and 36*b* of the first spline groove 36. That is, the first spline tooth 37 and the first spline groove 36 are constantly coupled in the circumferential direction C1.

As shown in FIG. 3, the sub damper 28 is inserted in the internal cylinder 46 and is detachable with respect to the internal cylinder 46. The respective third spline teeth 41 of the internal cylinder 46 are inserted in the corresponding third spline grooves 40 of the sub damper 28. The manner of coupling is the same for the respective third spline teeth 41 and the corresponding third spline grooves 40, and thus in the following description, the coupling of a single third spline teeth 41 with a single third spline groove 40 shall be described.

Figure 8:
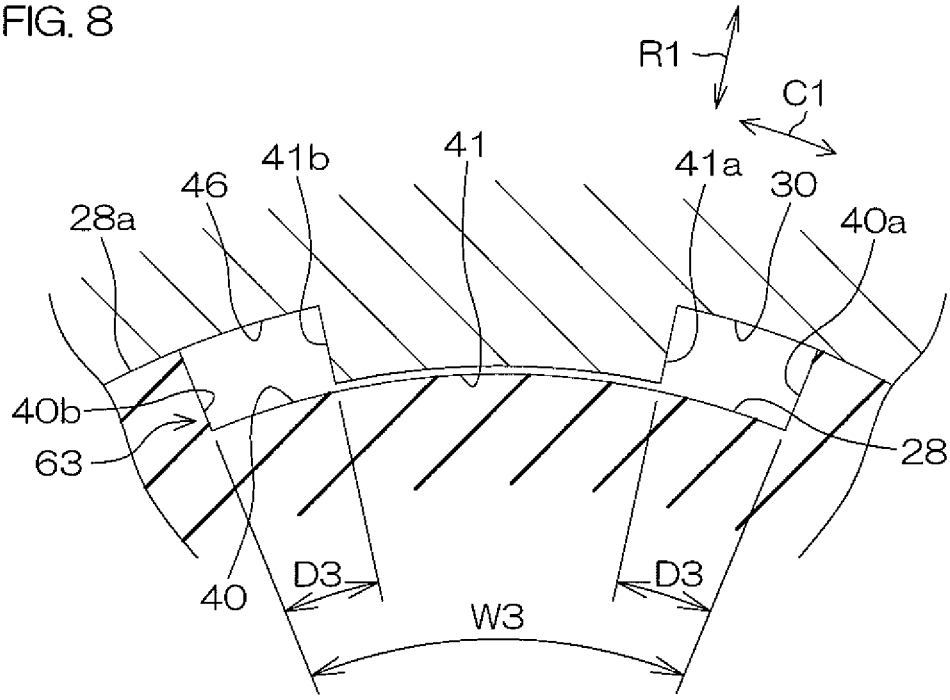
FIG. 8 is a sectional view taken along line VIII-VIII in FIG. 3.

As shown in FIG. 8, which is a sectional view taken along line VIII-VIII in FIG. 3, the third spline tooth 41 and a pair of side surfaces 40*a* and 40*b* of the third spline groove 40 are separated in the circumferential direction C1 of the propeller unit 16. That is, one side surface 41*a* of the third spline tooth 41 and one side surface 40*a* of the third spline groove 40 are separated across a predetermined gap D3. Likewise, the other side surface 41*b* of the third spline tooth 41 and the other side surface 40*b* of the third spline groove 40 are separated across the gap D3. The gap D3 is set, for example, to approximately 10 degrees as an angle about a central axis of the inner cylinder 30 (central angle).

As shown in FIG. 6, the first tooth 43*a* of the second spacer 26 is inserted in the first notch 44*a* of the outer cylinder 30.

The first tooth 43*a* and the pair of side surfaces 44*b* and 44*c* of the first notch 44*a* are separated in the circumferential direction C1. Specifically, one side surface 43*b* of the first tooth 43*a* and one side surface 44*b* of the first notch 44*a* are separated across a predetermined gap D2. Likewise, the other side surface 43*c* of the first tooth 43*a* and the other side surface 44*c* of the first notch 44*a* are separated across the gap D2.

The second tooth 43*d* of the second spacer 26 is inserted in the second notch 44*d* of the outer cylinder 30. The second tooth 43*d* and the pair of side surfaces 44*e* and 44*f* of the second notch 44*d* are separated in the circumferential direction C1. Specifically, one side surface 43*e* of the second tooth 43*d* and one side surface 44*e* of the second notch 44*d* are separated across the predetermined gap D2. Likewise, the other side surface 43*f* of the second tooth 43*d* and the other side surface 44*f* of the second notch 44*d* are separated across the gap D2. The gap D2 is set, for example, to approximately 15 degrees as an angle about a central axis of the inner cylinder 30 (central angle), and is greater than the central angle of the gap D3 (See FIG. 8) related to the third spline tooth 41.

The central angle of the gap D2 is set smaller than a positioning angle D4 of adjacent spline teeth of the spline hole 42*a* of the second spacer 26 (central angle corresponding to the interval between spline teeth, see FIG. 4C). Due to the central angle of the gap D2 being smaller than the positioning angle D4, the respective teeth 43*a* and 43*d* of the second spacer 26 cannot be inserted in the corresponding notches 44*a* and 44*d* if there is a deviation in an orientation of insertion of the propeller shaft 18 into the second spacer 26. Mistaking of the attachment position of the second spacer 26 can thus be prevented.

As shown in FIG. 3, a washer 49, into which the male thread portion 18*e* of the propeller shaft 18 is inserted, is arranged to the rear of the second spacer 26. A castle nut 50 that is threadingly coupled to the male thread portion 18*e* is arranged to the rear of the washer 49. A loosening preventing pin 51 is attached to the castle nut 50. By the castle nut 50 being threadingly coupled to the male thread portion 18*e*, the castle nut 50 acts together with the first spacer 24 to clamp the inner cylinder 25, the second spacer 26, and the washer 49.

The above is the general arrangement of the outboard motor 1. Operation of the propeller unit 16 shall now be described with reference to FIG. 9, which is a graph of a relationship of a twist angle of the main damper 27 and the driving force (torque) transmitted from the propeller shaft 18 to the outer cylinder 30, etc.

When a driving force is not being transmitted to the propeller shaft 18, the first spline tooth 37 and the first spline groove 36 are coupled in the circumferential direction C1 of the propeller unit 16 as shown in FIG. 7. That is, the first spline tooth 37 and the first spline groove 36 of the pair of first engaging portions 61 are constantly engaged in a manner enabling the transmission of the driving force. As shown in FIG. 8, the third spline tooth 41 is separated across the gap D3 from each of the pair of side surfaces 40*a* and 40*b* of the third spline groove 40. That is, in the pair of third engaging portions 63, the engaging of the third spline tooth 41 and the third spline groove 40 is disengaged. As shown in FIG. 6, the first tooth 43*a* of the second spacer 26 is separated across the gap D2 from each of the pair of side surfaces 44*b* and 44*c* of the first notch 44*a* of the outer cylinder 30. The second tooth 43*d* of the second spacer 26 is separated across the gap D2 from each of the pair of side surfaces 44*e* and 44*f* of the second notch 44*d*. That is, in the pair of second engaging portions 62, the engaging of the teeth 43 and the notches 44 is disengaged.

Referring to FIG. 1, when the dog clutch 19*d* becomes coupled to the forward drive gear 19*b*, the propeller shaft 18 begins to rotate to one side in the circumferential direction C1 of the propeller unit 16 (to a clockwise direction as viewed from the rear). In this process, an impact (shift shock) is transmitted from the dog clutch 19*d* to the main damper 27 via the propeller shaft 18 and the inner cylinder 25 of FIG. 3. A main cause of the shift shock is a large inertial mass of the propeller unit 16. For example, the shift shock is generated by a driving force, which tends to rotate the propeller unit 16 that is in the rotation-stopped state, being input into the propeller shaft 18. The main damper 27 undergoes elastic deformation in a twisting manner when the shift shock is input. The main damper 27 thereby absorbs the shift shock as shown in FIG. 3 and FIG. 9.

Figure 10A:
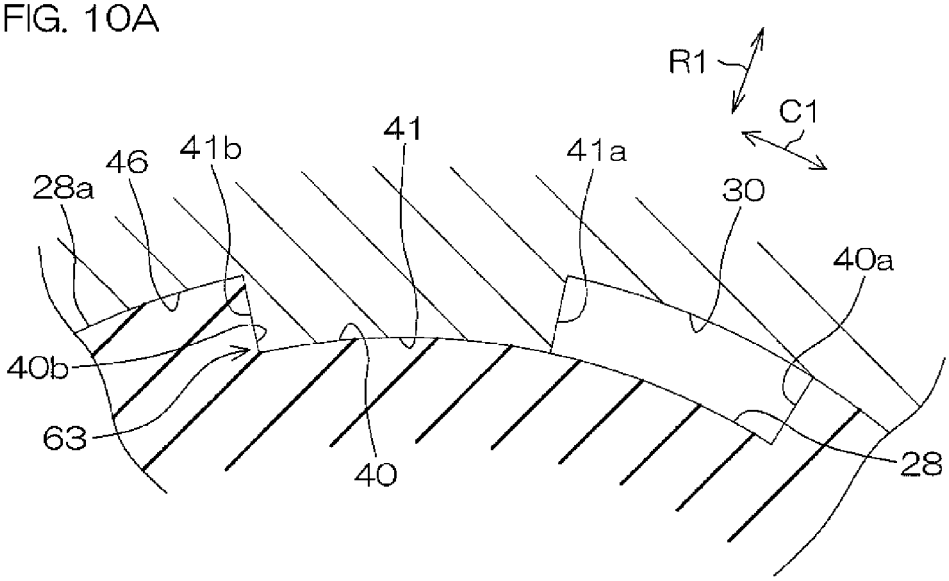
FIG. 10A is a sectional view of principal portions as viewed along the axial direction of the propeller unit and shows a state of engaging of a third spline tooth and a third spline groove.

When the output of the engine rises and the driving force of the propeller shaft 18 becomes not less than the predetermined first driving force, a twist angle due to elastic deformation of the main damper 27 exceeds the central angle of the gap D3 (10 degrees). A state is thereby entered in which the one side surface 40*b* of the third spline groove 40 of the rubber sub damper 28 elastically contacts the third spline tooth 41 such that the driving force is transmitted to the third spline tooth 41 as shown in FIG. 10A. That is, in the pair of third engaging portions 63, the third spline tooth 41 and the third spline groove 40 become engaged in a driving force transmittable manner. The driving force of the propeller shaft 18 is thereby transmitted to the outer cylinder 30 by the main damper 27 and the sub damper 28.

Figure 10B:
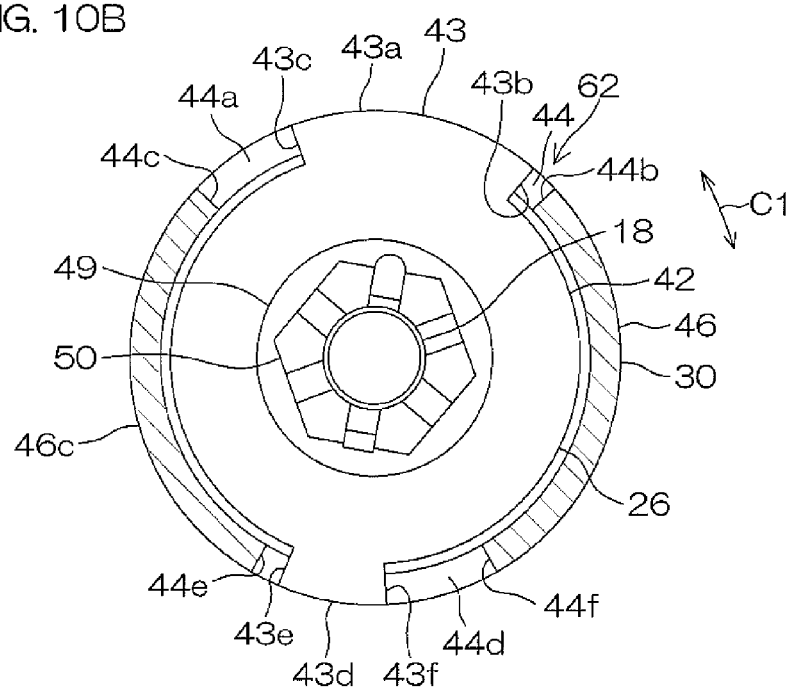
FIG. 10B is a diagram of principal portions as viewed along the axial direction of the propeller unit and shows a state of engaging of respective teeth of a second spacer and corresponding notches of the outer cylinder.

At this point, the first tooth 43*a* of the second spacer 26 is not in contact with the one side surface 44*b* of the first notch 44*a* of the outer cylinder 30 and the second tooth 43*d* is not in contact with the one side surface 44*e* of the second notch 44*d* of the outer cylinder 30 as shown in FIG. 10B. The second spacer 26 (the pair of second engaging portions 62) thus does not transmit the driving force of the propeller shaft 18 to the outer cylinder 30.

Figure 9:
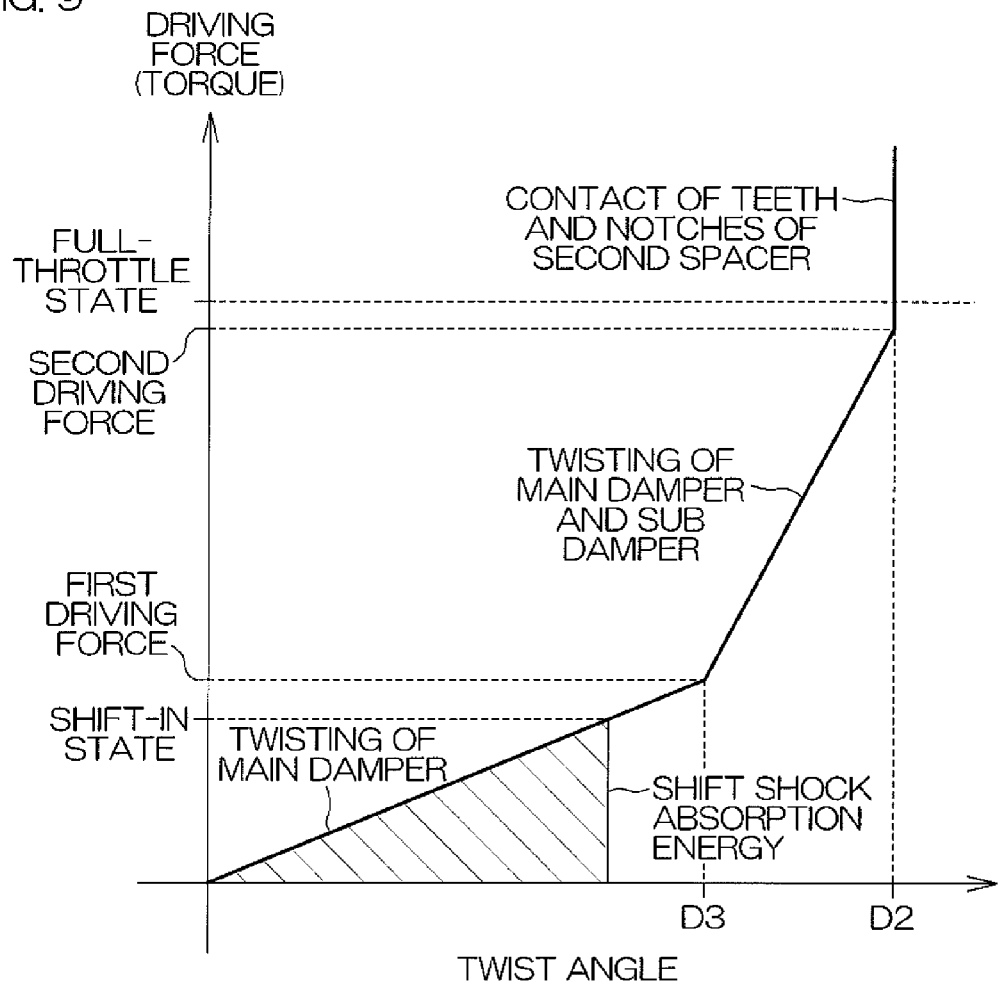
FIG. 9 is a graph of a relationship of a twist angle of the main damper and a driving force (torque) transmitted from the propeller shaft to an outer cylinder.
Figure 11:
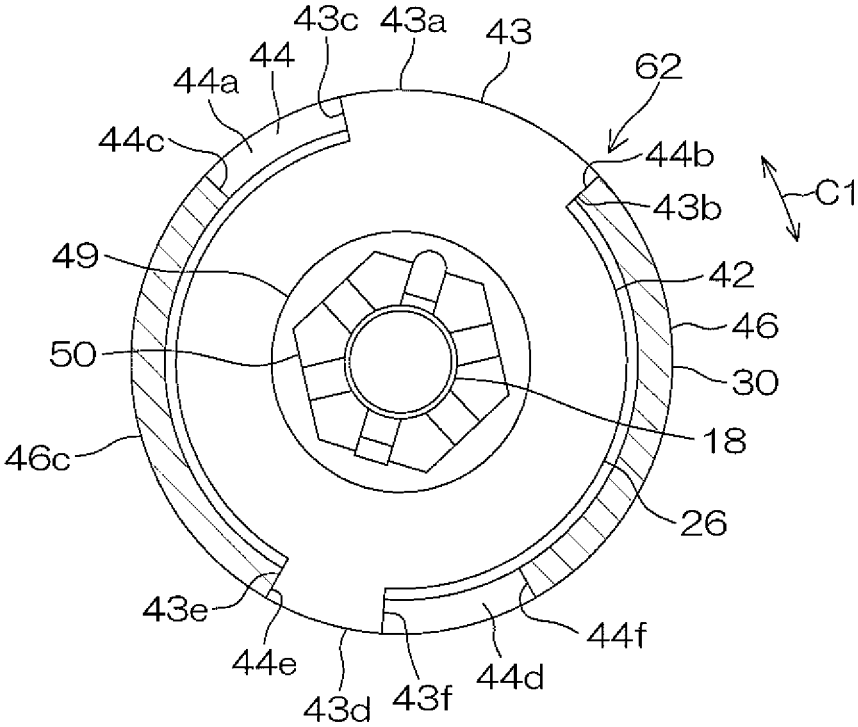
FIG. 11 is a diagram of principal portions as viewed along the axial direction of the propeller unit and shows the state of engaging of the respective teeth of the second spacer and the corresponding notches of the outer cylinder.

Referring to FIG. 3 and FIG. 9, when the output of the engine rises further, and the driving force of the propeller shaft 18 reaches the predetermined second driving force close to a full-throttle state of the engine, the elastic deformations of the main damper 27 and the sub damper 28 become large. The twist angle of the main damper 27 thus reaches the central angle of the gap D2. At this point, the first tooth 43*a* of the second spacer 26 contacts the one side surface 44*b* of the first notch 44*a* of the outer cylinder 30 and the second tooth 43*d* contacts the one side surface 44*e* of the second notch 44*d* of the outer cylinder 30 as shown in FIG. 11. That is, the teeth 43 and the notches 44 of the pair of second engaging portions 62 become engaged in a driving force transmittable manner. The second spacer 26 thus transmits the driving force of the propeller shaft 18 to the outer cylinder 30. Also, the respective teeth 43*a* and 43*d* of the metal second spacer 26 respectively become coupled to the side surfaces 44*b* and 44*e* of the notches 44*a* and 44*d* of the outer cylinder 30 in the circumferential direction C1 of the propeller unit 16. The main damper 27 and the sub damper 28 thus do not become twisted further. When the driving force of the propeller shaft 18 is not less than the second driving force, the driving force of the propeller shaft 18 is transmitted from the inner cylinder 25 to the outer cylinder 30 via the main damper 27, the sub damper 28, and the second spacer 26.

Next, when the driving force transmitted to the propeller shaft 18 falls below the second driving force, the twist angles of the main damper 27 and the sub damper 28 decrease due to elastic restoration forces of the main damper 27 and the sub damper 28. Consequently, the engaging of the respective teeth 43*a* and 43*d* of the second spacer 26 with the corresponding notches 44*a* and 44*d* of the outer cylinder 30 is disengaged. That is, the mutual engaging of the teeth 43 and the notches 44 of the pair of second engaging portions 62 is disengaged.

Referring to FIG. 3, when the driving force transmitted to the propeller shaft 18 decreases further thereafter, the twist angles of the main damper 27 and the sub damper 28 decrease due to the elastic restoration forces of the main damper 27 and the sub damper 28. When the driving force of the propeller shaft 18 falls below the first driving force, the engaging of the third spline tooth 41 with the third spline groove 40 is disengaged as shown in FIG. 8. That is, the mutual engaging of the third spline groove 40 and the third spline tooth 41 of the pair of third engaging portions 63 is disengaged. At this point, the driving force is transmitted from the propeller shaft 18 to the inner cylinder 30 by engaging of the first spline groove 36 of the main damper 27 with the first spine tooth 37 as shown in FIG. 7. That is, the mutual engaging of the first spline groove 36 and the first spline tooth 37 of the pair of first engaging portions 61 is not disengaged.

An operation when the driving force of the propeller shaft 18 is raised while making the propeller shaft 18 rotate counterclockwise by coupling of the dog clutch 19*d* to the reverse drive gear 19*c* is the same as the above with the exception that the rotation direction is opposite.

A case where a forward rotation operation and a reverse rotation operation are repeated shall now be considered. The forward rotation operation is an operation of making the propeller shaft 18 and the propeller unit 16 rotates clockwise. The reverse rotation operation is an operation of making the propeller shaft 18 and the propeller unit 16 rotates counterclockwise. Here, an operation of applying a fixed load in the forward rotation direction and thereafter applying the fixed load in the reverse rotation direction shall be regarded as one load cycle. A state after repeatedly applying the fixed load to the main damper 27 for a predetermined number of times (for example, 1000 times) of the load cycle shall now be considered. Even in this case, it can be judged that a critical load of the main damper 27 is not exceeded as long as a state where the main damper 27 loses its inherent function, such as breakage, plastic deformation, or slipping with respect to the outer cylinder 30, etc., of the main damper 27, does not occur. The second driving force is of a magnitude of a load that does not exceed the critical load. When a driving force that is not less than the second driving force is transmitted, the respective teeth 43*a* and 43*d* of the second spacer 26 contact the corresponding side surfaces 44*b* or 44*c* and 44*e* or 44*f* of the respective notches 44*a* and 44*d* due to elastic deformation of the main damper 27.

A state after repeatedly applying the fixed load to the sub damper 28 for a predetermined number of times (for example, 1000 times) of the load cycle shall now be considered. Even in this case, it can be judged that a critical load of the sub damper 28 is not exceeded as long as a state where the sub damper 28 loses its inherent function, such as breakage, plastic deformation, etc., of the sub damper 28, does not occur. The second driving force is also of a magnitude of a load that does not exceed this critical load. When a driving force that is not less than the first driving force is transmitted, the third spline tooth 41 of the outer cylinder 30 contacts one of the pair of side surfaces 40*a* and 40*b* of the third spline groove 40 of the sub damper 28 due to elastic deformation of the main damper 28.

The first driving force is, for example, approximately 60% of the second driving force. When the first driving force is approximately 230 (N·m), for example, the second driving force is approximately 140 (N·m).

As described above, according to the present preferred embodiment, the main damper 27 preferably is an elastic member and can thus absorb the shift shock and other impacts applied to the propeller shaft 18. The second spacer 26 is provided apart from the main damper 27. The driving force applied to the propeller shaft 18 can thus be transmitted to the outer cylinder 30 via the second spacer 26 when the driving force transmitted to the propeller shaft 18 is not less than the second driving force. The driving force that the main damper 27 needs to transmit from the propeller shaft 18 to the outer cylinder 30 may thus be small and the material of the main damper 27 can thus be made soft.

The effects of reducing shift shock and other impacts by the main damper 27 can thereby be increased. When the driving force transmitted to the propeller shaft 18 is less than the second driving force, the second spacer 26 is not coupled to the outer cylinder 30 in a manner enabling transmission of the driving force. In this case, the driving force applied to the propeller shaft 18 is transmitted to the outer cylinder 30 via the main damper 27. The impact absorbing effect by the main damper 27 can thus be exhibited reliably when the driving force applied to the propeller shaft 18 is less than the second driving force.

When the driving force transmitted to the propeller shaft 18 increases and the main damper 27 deforms elastically to some degree, a state where the respective teeth 43*a* and 43*d* of the second spacer 26 transmit the driving force to the corresponding notches 44*a* and 44*d* of the outer cylinder 30 is entered. The second driving force is set to be no more than the critical load of the main damper 27. The second spacer 26 thus becomes coupled and transmits the driving force to the outer cylinder 30 before a load that is not less than the critical load is applied to the main damper 27. Breakage of the main damper 27 can thus be prevented even if a large shock is applied to the inner cylinder 30 and the blades 33.

When the driving force transmitted to the propeller shaft 18 is not less than the second driving force, such as when the rotation speed of the propeller shaft 18 is high, etc., the driving force of the propeller shaft 18 can be transmitted to the outer cylinder 30 via the second spacer 26. The driving force applied to the propeller shaft 18 can thus be transmitted reliably to the outer cylinder 30 and the blades 33.

In a case where the marine vessel 2 travels through a rocky reef region, the blades 33 may contact a plurality of rocks and receive forces from the plurality of rocks. In this case, the blades 33 may alternatingly receive an impact force in the direction of rotation of the propeller unit 16 and an impact force in the opposite direction. The propeller unit 16 then repeatedly alternates between forward rotation and reverse rotation within a short time. The teeth 43 and the notches 44 of the pair of second engaging portions 62 thus tends to repeatedly undergo mutual engaging and disengagement of mutual engaging. That is, the respective teeth 43*a* and 43*d* of the second spacer 26 are directed alternately to the corresponding pair of side surfaces 44*b* and 44*c* and the pair of side surfaces 44*e* and 44*f* of the respective notches 44*a* and 44*d* of the outer cylinder 30 and tend to alternately contact the pair of side surfaces 44*b* and 44*c* and the pair of side surfaces 44*e* and 44*f*. However, the first spline tooth 37 is in constant contact with the first spline groove 36 of the main damper 27 that is formed of the elastic member. An impact that occurs when the respective teeth 43*a* and 43*d* of the second spacer 26 contact the corresponding side surfaces 44*b* and 44*c* and side surfaces 44*e* and 44*f* of the respective notches 44*a* and 44*d* can thereby be attenuated by the elastic deformation of the main damper 27. Impact noise can thereby be reduced.

The second spacer 26 made of metal is harder than the main damper 27 made of rubber and the driving force transmitted from the propeller shaft 18 to the outer cylinder 30 via the second spacer 26 can thus be made large. The share of the driving force of the propeller shaft 18 received by the main damper 27 can be decreased accordingly, and the effect of preventing the breakage of the main damper 27 can thereby be increased.

In the present preferred embodiment, the first spline grooves 36 of the main damper 27 clamp the first spline teeth 37 of the outer cylinder 30 in the circumferential direction C1 of the propeller unit 16. Constant engaging of the pair of first engaging portions 61 can thereby be realized in a simple manner. The impact noise reducing effect can be more enhanced by making the first spline grooves 36 and the first spline teeth 37 be constantly engaged in a manner enabling transmission of the driving force. Further, variation of the twisting operation of the outer cylinder 30 with respect to the inner cylinder 25 can be prevented. When the driving force of the propeller shaft 18 is large, the operation of the outer cylinder 30 with respect to the inner cylinder 25 is made invariable by the coupling of the respective teeth 43*a* and 43*d* of the second spacer 26 to the corresponding notches 44*a* and 44*d* of the outer cylinder 30.

For example, according to the arrangement of US 2007/053777A1, the driving force (slip torque) at which the inner cylinder begins to slip with respect to the outer cylinder is large in variation due to dimensional tolerances of the damper rubber and the tolerance ring. This problem can be surmounted by the arrangement of the present preferred embodiment.

According to the arrangement of US 2007/053777A1, the C-shaped tolerance ring, which tends to spread outward in the radial direction of the intermediate cylinder, is arranged on an outer circumference of the intermediate cylinder. Consequently, a press-fitting load of the intermediate cylinder in inserting the intermediate cylinder in the outer cylinder is large and the propeller unit is poor in ease of assembly.

On the other hand, according to the present preferred embodiment of the present invention, the main damper 27 and the sub damper 28 can be made soft. The press-fitting loads for inserting the main damper 27 and the sub damper 28 into the internal cylinder 46 of the outer cylinder 30 thus suffices to be small and the propeller unit 16 is good in ease of assembly.

When the driving force transmitted to the propeller shaft 18 is less than the first driving force, the driving force applied to the propeller shaft 18 is transmitted from the inner cylinder 25 to the outer cylinder 30 via the main damper 27. When the driving force transmitted to the propeller shaft 18 is not less than the first driving force and less than the second driving force, the driving force applied to the propeller shaft 18 is transmitted to the outer cylinder 30 via the main damper 27 and the sub damper 28. When the driving force transmitted to the propeller shaft 18 is not less than the second driving force, the driving force applied to the propeller shaft 18 is transmitted to the outer cylinder 30 via the main damper 27, the second spacer 26, and the sub damper 28.

The main damper 27 is thus not required to transmit a large driving force and thus mainly absorbs the shift shock and other impacts effectively. The second spacer 26 can be used as a member that transmits the driving force applied to the propeller shaft 18 when the driving force transmitted to the propeller shaft 18 is not less than the second driving force (in a high load state). Moreover, in a case where the driving force transmitted to the propeller shaft 18 is not less than the second driving force (high load state), the large driving force can be transmitted by the pair of second engaging portions 62 by contact of the respective teeth 43*a* and 43*d* of the second spacer 24 and the corresponding side surfaces 44*b* or 44*c* and 44*e* or 44*f* of the respective notches 44*a* and 44*d*.

The sub damper 28 can be used as a member that transmits the driving force when the driving force transmitted to the propeller shaft 18 is not less than the first driving force and less than the second driving force and absorbs impacts acting on the propeller shaft 18. Thus, when the driving force transmitted to the propeller shaft 18 becomes not less than the first driving force, the driving force applied to the propeller shaft 18 is transmitted to the outer cylinder 30 by the sub damper 28 in addition to the main damper 27. The load acting on the main damper 27 is thus small, and the main damper 27 can thus be formed of a softer material. The effect of absorbing the shift shock and other impacts by the main damper 27 can thus be made higher. When the driving force transmitted to the propeller shaft 18 is not less than the first driving force and less than the second driving force, the large driving force can be transmitted by the pair of third engaging portions 63 by contact of the third spline tooth 41 and the corresponding side surface 40*a* or 40*b* of the third spline groove 40.

When a large driving force that is not less than the second driving force is transmitted to the propeller shaft 18 in accompaniment with shift switching, etc., the main damper 27 deforms elastically and thereafter, the sub damper 28 deforms elastically. The impact, such as the shift shock, etc., in this process is absorbed in at least two stages. The respective teeth 43*a* and 43*d* of the second spacer 24 of the pair of second engaging portions 62 thus undergo so-called soft landing on the corresponding side surface 44*b* or 44*c* and side surface 44*e* or 44*f* of the respective notches 44*a* and 44*d*. The impact that occurs when the respective teeth 43*a* and 43*d* of the pair of second engaging portions 62 contact the corresponding side surface 44*b* or 44*c* and side surface 44*e* or 44*f* of the respective notches 44*a* and 44*d* is thus small.

The second driving force is less than the critical load of the main damper 27 and less than the critical load of the sub damper 28. The main damper 27 and the sub damper 28 can thus be made of soft materials to increase the impact absorbing effects of the main damper 27 and the sub damper 28 and yet breakage of the main damper 27 and the sub damper 28 can be prevented.

By both the main damper 27 and the sub damper 28 deforming elastically, an absorption amount of an impact energy that acts on the propeller shaft 18 can be made adequately high. The main damper 27 and the sub damper 28 are small in the loads (press-fitting loads) of insertion into the internal cylinder 46 of the outer cylinder 30 and can thus be made easily deformable elastically and high in the impact energy absorption amount. Burdens placed on the power transmission system, such as the propeller shaft 18, the dog clutch 19*d*, etc., and shift shock noise can thus be reduced.

The main damper 27 and the sub damper 28 are arranged to deform elastically when the teeth 43*a* and 43*d* of the second spacer 26 contact the corresponding notches 44*a* and 44*d* of the outer cylinder 30. The impact that occurs when the respective teeth 43*a* and 43*d* of the second spacer 26 contact the corresponding notches 44*a* and 44*d* can thus be reduced.

Slipping of the main damper 27 with respect to the outer cylinder 30 in the circumferential direction C1 of the propeller unit 16 can be prevented by the coupling of the first spline groove 36 of the main damper 27 to the first spline tooth 37 of the outer cylinder 30. Slipping of the sub damper 28 with respect to the outer cylinder 30 in the circumferential direction C1 of the propeller unit 16 can be prevented by the coupling of the third spline groove 40 of the sub damper 28 to the third spline tooth 41 of the outer cylinder 30.

The spring constant of the sub damper 28 is made greater than the spring constant of the main damper 27. The driving force that the sub damper 28 can transmit from the inner cylinder 25 to the outer cylinder 30 can thereby be made greater. The driving force that the main damper 27 must transmit from the inner cylinder 25 to the outer cylinder 30 can be decreased correspondingly, and the main damper 27 can thus be made softer.

The gap D3 between one side surface 40*a* of the third spline groove 40 and the third spline tooth 41 and the gap D3 between the other side surface 40*b* of the third spline groove 40 and the third spline tooth 41 are made equal. The actions of the sub damper 28 can thereby be made equivalent in the case where the propeller shaft 18 rotates clockwise and the case where the propeller shaft 18 rotates counterclockwise. That is, the sub damper 28 can exhibit the function of transmitting the driving force of the propeller shaft 18 and the function of absorbing the shock of the propeller shaft 18 equivalently in respective cases of rotation of the propeller shaft 18 in either rotation direction.

The driving force that can be transmitted from the sub damper 28 to the outer cylinder 30 can be made large by the coupling of the plurality of third spline teeth 41 and the plurality of third spline grooves 40 arranged to extend in the axial direction A1 of the propeller unit 16. The driving force that the main damper 27 must transmit when the second spacer 26 is not transmitting the driving force to the outer cylinder 30 can thus be made small. The main damper 27 can thus be made softer. The sub damper 28 is engaged with the outer cylinder 30 at a plurality of locations along its circumferential direction. The sub damper 28 thus deforms elastically substantially uniformly as a whole when absorbing an impact of the propeller shaft 18. The impact absorbing effect is thereby improved and the sub damper 28 can be made long in life.

The main damper 27 is coupled to the outer cylinder 30 at a plurality of locations along its circumferential direction by the coupling of the plurality of first teeth 37 and the plurality of first spline grooves 36 arranged to extend in the axial direction A1 of the propeller unit 16 and thus the force of coupling to the outer cylinder 30 is strong. The main damper 27 can thus be prevented from slipping with respect to the outer cylinder 30 or breaking. The impact absorbing function and the driving force transmitting function of the main damper 27 can thus be improved.

The respective third spline teeth 41 and the corresponding first spline teeth 37 are matched in position in the circumferential direction C1. A single spline tooth located on the inner circumferential surface 46*b* of the outer cylinder 30 can thereby be used as the first spline tooth 37 and the third spline tooth 41. Manufacture of the propeller unit 16 that includes the first spline tooth 37 and the third spline tooth 41 is thus facilitated.

The respective teeth 43*a* and 43*d* of the second spacer 26 and the respective notches 44*a* and 44*d* of the outer cylinder 30 are arranged in plurality at equal intervals in the circumferential direction C1 and the respective notches 44*a* and 44*d* of the outer cylinder 30 are arranged in plurality at equal intervals in the circumferential direction C1. A distribution of the driving force transmitted from the second spacer 26 to the outer cylinder 30 can thereby be made more uniform in the circumferential direction C1.

A simple arrangement in which the notches 44*a* and 44*d* are provided in the rear end portion 46*c* of the internal cylinder 46 of the outer cylinder 30 can be adopted. The teeth 43*a* and 43*d* can be inserted readily into the corresponding notches 44*a* and 44*d* from the rear of the notches 44*a* and 44*d*, and assembly of the propeller unit 16 is thus made easy.

The number of teeth of the second spacer 26 is set to two, and the number of notches of the outer cylinder 30 is set to two. Adequate rigidity of the rear end portion 46*c* of the internal cylinder 46 of the outer cylinder 30 can thereby be secured and a large driving force can be transmitted between the second spacer 26 and the outer cylinder 30. The second spacer 26 and the outer cylinder 30 are coupled at two locations. Thus, in comparison to a case where the second spacer 26 and the outer cylinder 30 are coupled at just one location, biasing of load can be prevented in both the second spacer 26 and the outer cylinder 30.

The second spacer 26 of the present preferred embodiment of the present invention can be used in place of a spacer that was simply a disk conventionally, and there is no need to separately provide an installation space for the second spacer 26. The propeller unit 16 of the present preferred embodiment of the present invention can thus be used without changing the length of the propeller shaft 18.

When the driving force transmitted to the propeller shaft 18 is not less than the second driving force, the driving force of the propeller shaft 18 can be transmitted from the inner cylinder 25 to the outer cylinder 30 by engaging of the first tooth 43*a* and the first notch 44*a* and the engaging of the second tooth 43*d* and the second notch 44*d*. The width of the second notch 44*d* is made narrower than the width W5 of the first tooth 43*a*, and erroneous insertion of the first tooth 43*a* in the second notch 44*d* can thus be prevented. The respective teeth 43*a* and 43*d* and the corresponding notches 44*a* and 44*d* can thereby be engaged in the designed manner.

The gap D2 between the side surfaces 44*b* and 44*e* at one side of the respective notches 44*a* and 44*d* and the corresponding teeth 43*a* and 43*d*, and the gap D2 between the side surfaces 44*c* and 44*f* at the other side of the respective notches 44*a* and 44*d* and the corresponding teeth 43*a* and 43*d* are made equal. The operation of the spacer 26 can thus be made equivalent in the case where the propeller shaft 18 rotates clockwise and the case where the propeller shaft 18 rotates counterclockwise.

By use of the outer cylinder 30 that includes the external cylinder 45 and the internal cylinder 46, a space between the external cylinder 45 and the internal cylinder 46 can be used as the exhaust port 48 for the exhaust from the engine 14 that drives the propeller shaft 18. The propeller unit 16 is arranged such that the impact absorbing function is mainly borne by the main damper 27 and the driving force transmission is mainly borne by the second spacer 28. Such an impact absorbing structure and driving force transmission structure can be housed within a narrow space at the inner side of the internal cylinder 46.

The inner circumferential surface 46*b* of the internal cylinder 46 preferably has a tapered shape that increases in diameter toward the rear. The main damper 27 can thereby be automatically centered with respect to the inner circumferential surface 46*b* of the internal cylinder 46 by press-fitting the main damper 27 into the internal cylinder 46. The main damper 27 can thus be press-fitted easily into the internal cylinder 46.

By the above, the outboard motor 1 can be realized with which shift shock and other impacts acting on the propeller shaft 18 can be prevented, the driving force from the propeller shaft 18 can be transmitted to the blades 33, and impact noise during travel through a rocky reef region can be prevented.

According to the present invention, besides the preferred embodiment described above, various design changes can be applied within the scope of the matters described in the claims, for example, as described below. In the following description, members arranged to have the same functions as those of the arrangement described above shall be provided with the same symbols and description thereof shall be omitted.

For example, although in the preferred embodiment of the present invention described above, the first driving force is preferably set to approximately 60% of the second drive force, the present invention is not limited thereto. The first driving force suffices to be lower than the second drive force and may be approximately 50% of the second driving force.

Although in the preferred embodiment of the present invention described above, the first tooth 43*a* and the second tooth 43*d* that differ in tooth width are preferably provided on the second spacer 26, the present invention is not limited thereto. A plurality of teeth of the same tooth width may be provided on the second spacer 26. In this case, the respective grooves of the outer cylinder 30 are made equal in groove width in the circumferential direction C1.

Although in the preferred embodiment of the present invention described above, the outer cylinder 30 preferably includes the internal cylinder 46 and the external cylinder 45, the present invention is not limited thereto. For example, the outer cylinder may be formed of a single cylinder.

A plurality of sub dampers may be provided. In this case, the sub dampers may preferably be aligned in the axial direction A1 of the propeller unit 16. In this case, the respective sub dampers may be differed as suited in hardness and spline groove width. The driving force applied to the propeller shaft 18 when a third spline tooth 41 of the outer cylinder 30 contacts a side surface of a third spline groove of the sub damper is thereby made to differ mutually among the respective sub dampers. The driving force transmitted to the respective sub dampers can thereby be set more finely. Shift shock and the impact that occurs when the respective teeth 43*a* and 43*d* of the second spacer 26 engage with the corresponding notches 44*a* and 44*d* of the outer cylinder 30 can be absorbed in a stepwise manner by the plurality of sub dampers.

Figure 12:
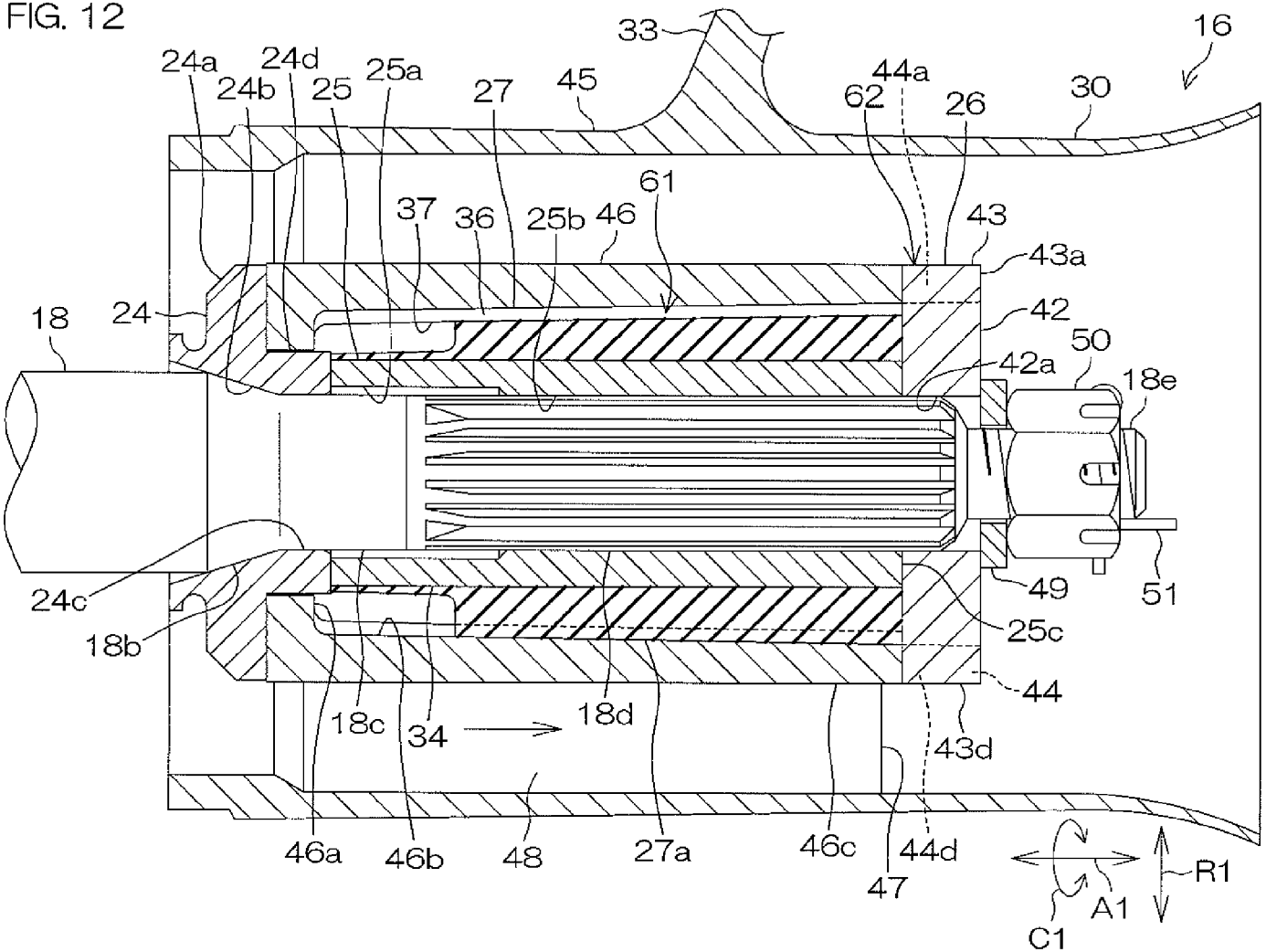
FIG. 12 is a diagram of principal portions of another preferred embodiment of the present invention as viewed in a section parallel to an axial direction of a propeller unit.
Figure 13:
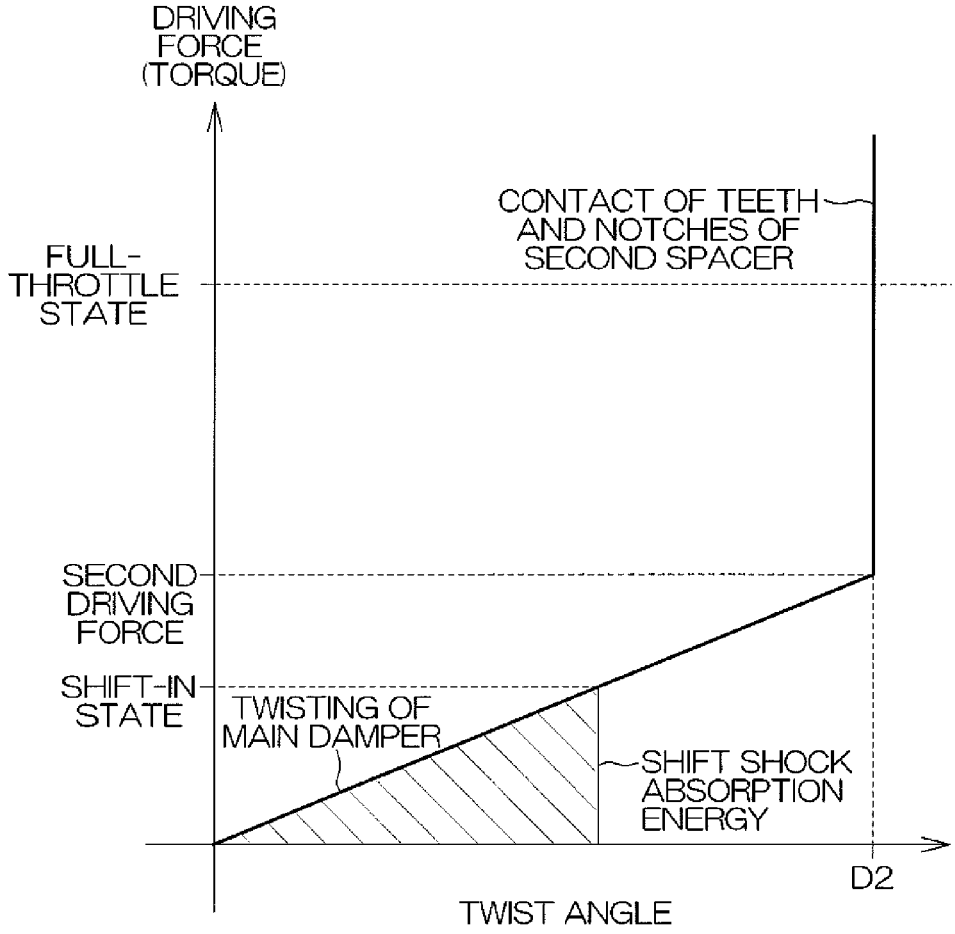
FIG. 13 is a graph of a relationship of a twist angle of the main damper and a driving force (torque) transmitted from a propeller shaft to an outer cylinder in the other preferred embodiment of the present invention.

Although the preferred embodiment of the present invention described above preferably has the arrangement where the main damper 27 and the sub damper 28 are aligned in the axial direction A1, the present invention is not limited thereto. As shown in FIG. 12, the sub damper 28 may be omitted. In the axial direction A1, the main damper 27 is extended to the location at which the sub damper 28 was arranged. The main damper 27 and second spacer 26 are juxtaposed in the axial direction A1. In this case, when the twist angle of the main damper 27 becomes equal to the central angle of the gap D2 as shown in the graph of FIG. 13 and the driving force of the propeller shaft 18 becomes equal to the second driving force, the respective teeth 43*a* and 43*d* of the second spacer 26 become coupled to the corresponding notches 44*a* and 44*d* of the outer cylinder 30.

Figure 14:
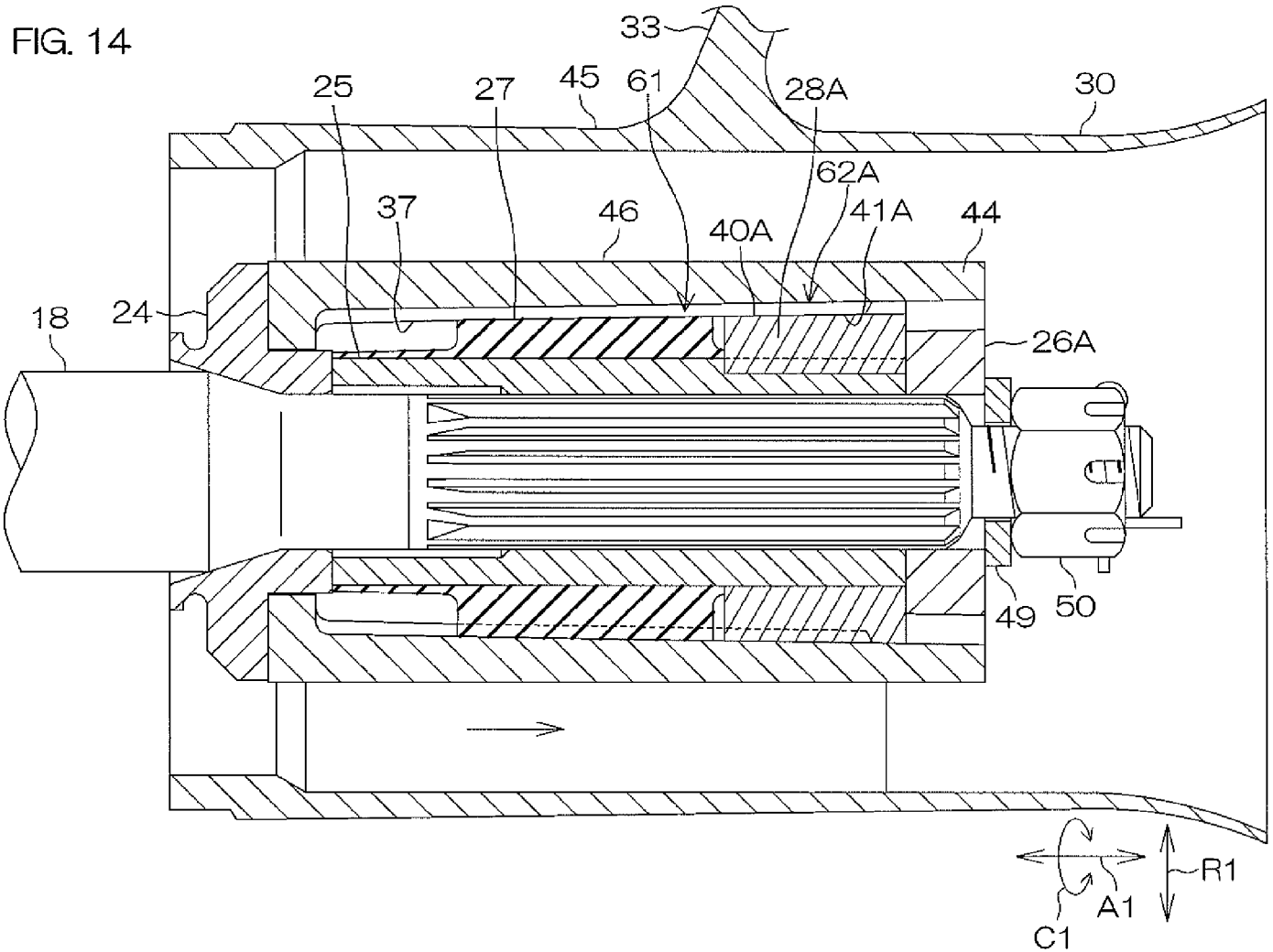
FIG. 14 is a diagram of principal portions of yet another preferred embodiment of the present invention as viewed in a section parallel to an axial direction of a propeller unit.

As shown in FIG. 14, a rear second spacer 26A may be used in place of the second spacer 26, and a front second spacer 28A may be used in place of the sub damper 28. The rear second spacer 26A is not provided with a tooth and is arranged so as not to engage (so as not to become coupled in a driving force transmittable manner) with the outer cylinder 30.

The front second spacer 28A is preferably formed of brass (metal), etc., and is harder than the main damper 27. Besides the material, the front second spacer 28A is the same in arrangement as the sub damper 28. The front second spacer 28A is an example of the "second driving force transmitting member" according to a preferred embodiment of the present invention.

A spline groove 40A of the front second spacer 28A is an example of the "second groove" according to a preferred embodiment of the present invention, and a spline tooth 41A of the internal cylinder 46 of the outer cylinder 30 is an example of the "second protrusion" according to a preferred embodiment of the present invention. A pair of second engaging portions 62A are provided by the spline groove 40A and the spline tooth 41A.

The relationship between the twist angle of the main damper 27 and the driving force (torque) transmitted from the propeller shaft 18 to the outer cylinder 30 is the same as that of the graph of FIG. 13.

In this case, the sub damper 28 may be provided between the main damper 27 and the front second spacer 28A.

The first spline grooves 36 and the first spline teeth 37 of the pair of first engaging portions 61 do not have to be engaged in a driving force transmittable manner when the driving force of the propeller shaft 18 is low (for example, during idling).

Although an outboard motor was described above as an example of the marine vessel propulsion device to which the propeller unit 16 is attached, the present invention is not restricted thereto. The marine vessel propulsion device may be an inboard/outboard motor (a stern drive or an inboard motor/outboard drive), an inboard motor, or other marine vessel propulsion device.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2010-42813 filed in the Japan Patent Office on Feb. 26, 2010, and the entire disclosure of the application is incorporated herein by reference.

What is claimed is:

1. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and including a protrusion and a groove arranged to mutually engage such that a driving force is transmittable to each other, the protrusion being provided on an inner circumferential surface of the outer cylinder and arranged to protrude inward from the inner circumferential surface of the outer cylinder, and the groove being provided in an outer circumferential surface of the first driving force transmitting member; and a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft.

2. The propeller unit according to claim 1, wherein the pair of second engaging portions include:

a protrusion provided on the second driving force transmitting member; and a groove, provided in the outer cylinder, including a pair of side surfaces opposing each other in a circumferential direction of the outer cylinder, the groove arranged such that the protrusion is inserted between the pair of side surfaces, the groove arranged such that gaps are provided between the protrusion and the side surfaces when a driving force is not transmitted to the propeller shaft, the groove arranged such that the protrusion is made to contact one of the pair of side surfaces due to elastic deformation of the first driving force transmitting member when a driving force that is not less than the reference driving force not exceeding the critical load of the first driving force transmitting member is transmitted to the propeller shaft.

3. The propeller unit according to claim 1, wherein the pair of second engaging portions include:

a protrusion provided on the outer cylinder; and a groove, provided in the second driving force transmitting member, including a pair of side surfaces opposing each other in a circumferential direction of the outer cylinder, the groove arranged such that the protrusion is inserted between the pair of side surfaces, the groove arranged such that gaps are provided between the protrusion and the side surfaces when a driving force is not transmitted to the propeller shaft, the groove arranged such that the protrusion is made to contact one of the pair of side surfaces due to elastic deformation of the first driving force transmitting member when a driving force that is not less than the reference driving force not exceeding the critical load of the first driving force transmitting member is transmitted to the propeller shaft.

4. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and arranged to mutually engage such that a driving force is transmittable to each other;

a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft;

a third driving force transmitting member including a cylindrical elastic member arranged between the inner cylinder and the outer cylinder; and a pair of third engaging portions, provided on the outer cylinder and the third driving force transmitting member, arranged such that the third engaging portions are disengaged when a driving force is not transmitted to the propeller shaft, and arranged such that the third engaging portions become mutually engaged in a driving force transmittable manner due to elastic deformation of the first driving force transmitting member when a driving force that is not less than a first driving force less than the reference driving force is transmitted to the propeller shaft; wherein the pair of second engaging portions are arranged such that the second engaging portions become mutually engaged in a driving force transmittable manner due to elastic deformation of the first driving force transmitting member and the third driving force transmitting member when a driving force that is not less than a second driving force is transmitted to the propeller shaft, the second driving force being the reference driving force not exceeding the critical load of the first driving force transmitting member and not exceeding a critical load of the third driving force transmitting member.

5. The propeller unit according to claim 4, wherein the pair of third engaging portions include:

a protrusion provided on the outer cylinder and arranged to protrude inward from the inner circumferential surface of the outer cylinder; and a groove, provided in the third driving force transmitting member, including a pair of side surfaces opposing each other in a circumferential direction of the outer cylinder, the groove arranged such that the protrusion is inserted between the pair of side surfaces, the groove arranged such that gaps are provided between the protrusion and the side surfaces when a driving force is not transmitted to the propeller shaft, the groove arranged such that the protrusion is made to contact one of the pair of side surfaces due to elastic deformation of the first driving force transmitting member when a driving force that is not less than the first driving force less than the reference driving force is transmitted to the propeller shaft.

6. The propeller unit according to claim 4, wherein a spring constant of the third driving force transmitting member is greater than a spring constant of the first driving force transmitting member.

7. The propeller unit according to claim 5, wherein the protrusion and the groove are arranged such that a gap between one of the side surfaces of the groove and the protrusion, and a gap between the other of the side surfaces of the groove and the protrusion are equal when a driving force is not transmitted to the propeller shaft.

8. The propeller unit according to claim 5, wherein the protrusion includes a plurality of spline teeth each arranged to extend in the axial direction, the groove includes a plurality of spline grooves each arranged to extend in the axial direction, the spline teeth are arranged at equal intervals in a circumferential direction of the outer cylinder, and the spline grooves are arranged at equal intervals in the circumferential direction of the outer cylinder.

9. The propeller unit according to claim 1, wherein the protrusion includes a plurality of spline teeth each arranged to extend in the axial direction, the groove includes a plurality of spline grooves arranged to extend in the axial direction, the spline teeth are arranged at equal intervals in a circumferential direction of the outer cylinder, and the spline grooves are arranged at equal intervals in the circumferential direction of the outer cylinder.

10. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and arranged to mutually engage such that a driving force is transmittable to each other; and a pair of second engaging portions arranged on the outer cylinder and the second driving force transmitting member arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft; wherein the pair of second engaging portions include:

a plurality of protrusions provided on the second driving force transmitting member; and a plurality of grooves provided in the outer cylinder, each of the plurality of grooves including a pair of side surfaces opposing each other in a circumferential direction of the outer cylinder, each of the plurality of grooves arranged such that each of the plurality of protrusions are inserted between the pair of side surfaces, respectively, each of the plurality of grooves arranged such that gaps are provided between the plurality of protrusions and the side surfaces when a driving force is not transmitted to the propeller shaft, each of the plurality of grooves arranged such that the plurality of protrusions are made to contact one of the pair of side surfaces due to elastic deformation of the first driving force transmitting member when a driving force that is not less than the reference driving force not exceeding the critical load of the first driving force transmitting member is transmitted to the propeller shaft; and the plurality of protrusions are arranged at equal intervals in the circumferential direction, and the plurality of grooves are arranged at equal intervals in the circumferential direction.

11. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and arranged to mutually engage such that a driving force is transmittable to each other; and a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft wherein the pair of second engaging portions include:

a protrusion provided on the second driving force transmitting member; and a groove, provided in the outer cylinder, including a pair of side surfaces opposing each other in a circumferential direction of the outer cylinder, the groove arranged such that the protrusion is inserted between the pair of side surfaces, the groove arranged such that gaps are provided between the protrusion and the side surfaces when a driving force is not transmitted to the propeller shaft, the groove arranged such that the protrusion is made to contact one of the pair of side surfaces due to elastic deformation of the first driving force transmitting member when a driving force that is not less than the reference driving force not exceeding the critical load of the first driving force transmitting member is transmitted to the propeller shaft; and the protrusion includes a tooth located on an outer circumference of the second driving force transmitting member, and the groove includes a notch provided on an end surface of the outer cylinder.

12. The propeller unit according to claim 11, wherein the tooth includes a first tooth having a predetermined width in the circumferential direction, and a second tooth having a width in the circumferential direction narrower than the width of the first tooth;

the notch includes a first notch that is longer in the circumferential direction than the first tooth, and a second notch that is narrower in the circumferential direction than the first tooth;

the first tooth is inserted in the first notch, and the second tooth is inserted in the second notch.

13. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and arranged to mutually engage such that a driving force is transmittable to each other; and a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft;

wherein the pair of second engaging portions include:

a protrusion provided on the second driving force transmitting member; and a groove, provided in the outer cylinder, including a pair of side surfaces opposing each other in a circumferential direction of the outer cylinder, the groove arranged such that the protrusion is inserted between the pair of side surfaces, the groove arranged such that gaps are provided between the protrusion and the side surfaces when a driving force is not transmitted to the propeller shaft, the groove arranged such that the protrusion is made to contact one of the pair of side surfaces due to elastic deformation of the first driving force transmitting member when a driving force that is not less than the reference driving force not exceeding the critical load of the first driving force transmitting member is transmitted to the propeller shaft; and the protrusion and the groove are arranged such that a gap between one of the side surfaces of the groove and the protrusion, and a gap between the other of the side surfaces of the groove and the protrusion are equal when a driving force is not transmitted to the propeller shaft.

14. The propeller unit according to claim 1, wherein the outer cylinder includes an external cylinder integral with the blades, and an internal cylinder provided at an inner side of the external cylinder and arranged to define the inner circumferential surface of the outer cylinder.

15. A marine vessel propulsion device comprising:

an engine;

a driveshaft arranged to be rotated by the engine;

a drive gear fixed to the driveshaft;

a forward drive gear arranged to engage with the drive gear;

a reverse drive gear arranged to engage with the drive gear and to rotate in an opposite direction of the forward drive gear;

a dog clutch arranged to selectively engage with the forward drive gear and the reverse drive gear;

a propeller shaft arranged to rotate together with the dog clutch; and a propeller unit coupled to the propeller shaft, the propeller unit including:

an inner cylinder attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and including a protrusion and a groove arranged to mutually engage such that a driving force is transmittable to each other, the protrusion being provided on an inner circumferential surface of the outer cylinder and arranged to protrude inward from the inner circumferential surface of the outer cylinder, and the being groove provided in an outer circumferential surface of the first driving force transmitting member; and a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged in a driving force transmittable manner due to elastic deformation of the first driving force transmitting member when a driving force that is not less than a reference driving force not exceeding a critical load of the first driving force transmitting member is transmitted to the propeller shaft.

16. A propeller unit arranged to be coupled to a propeller shaft of a marine vessel propulsion device, the propeller unit comprising:

an inner cylinder arranged to be attached to the propeller shaft;

an outer cylinder having a cylindrical shape coaxial with the inner cylinder and including blades fixed on an outer circumferential surface of the outer cylinder;

a first driving force transmitting member including a cylindrical elastic member arranged between the inner cylinder and the outer cylinder;

a second driving force transmitting member arranged between the inner cylinder or the propeller shaft and the outer cylinder and aligned with the first driving force transmitting member in an axial direction of the outer cylinder;

a pair of first engaging portions arranged on the outer cylinder and the first driving force transmitting member and including a protrusion and a groove arranged to mutually engage such that a driving force is transmittable to each other, the protrusion being provided on an inner circumferential surface of the outer cylinder and arranged to protrude inward from the inner circumferential surface of the outer cylinder, and the groove being provided in an outer circumferential surface of the first driving force transmitting member; and a pair of second engaging portions arranged on the outer cylinder and the second driving force transmitting member and arranged such that the second engaging portions are disengaged when a driving force is not transmitted to the propeller shaft, and arranged such that the second engaging portions become mutually engaged to transmit a driving force due to elastic deformation of the first driving force transmitting member.

17. The propeller unit according to claim 16, wherein each of the protrusion and the groove are arranged to extend in the axial direction.

18. The propeller unit according to claim 1, wherein the pair of second engaging portions are separated by a predetermined gap in a circumferential direction of the outer cylinder when the driving force is not transmitted to the propeller shaft.

19. The propeller unit according to claim 16, wherein the pair of second engaging portions are separated by a predetermined gap in a circumferential direction of the outer cylinder when the driving force is not transmitted to the propeller shaft.

* * * * *